United States Patent [19]

Kubota et al.

[11] Patent Number: 5,056,947

[45] Date of Patent: Oct. 15, 1991

[54] DUAL REFILL-TYPE WRITING UTENSIL

[75] Inventors: Masuo Kubota; Hidehei Kageyama; Saburo Kobayashi; Yoshihide Mitsuya; Tadayoshi Ebinuma, all of Kawagoe, Japan

[73] Assignee: Kotobuki & Co., Ltd., Kyoto, Japan

[21] Appl. No.: 563,808

[22] Filed: Aug. 6, 1990

Related U.S. Application Data

[63] Continuation of Ser. No. 268,478, Nov. 8, 1988, abandoned, which is a continuation of Ser. No. 6,070, Jan. 22, 1987, abandoned.

[30] Foreign Application Priority Data

| | | | |
|---|---|---|---|
| Aug. 7, 1986 | [JP] | Japan | 61-184317 |
| Aug. 19, 1986 | [JP] | Japan | 61-192161 |
| Aug. 19, 1986 | [JP] | Japan | 61-192162 |
| Aug. 25, 1986 | [JP] | Japan | 61-197415 |

[51] Int. Cl.[5] ..... B43K 24/10; B43K 24/14

[52] U.S. Cl. ..... 401/29; 401/32; 401/33

[58] Field of Search ..... 401/29, 30, 32, 33

[56] References Cited

U.S. PATENT DOCUMENTS

| | | | |
|---|---|---|---|
| 2,704,532 | 3/1955 | Musser | 401/32 |
| 2,837,057 | 6/1958 | Morlock et al. | 401/33 |
| 3,898,008 | 8/1975 | Ganz | 401/30 |
| 4,202,641 | 5/1980 | Tomura | 401/33 X |
| 4,738,557 | 4/1988 | Yumoto | 401/29 |

FOREIGN PATENT DOCUMENTS

| | | | |
|---|---|---|---|
| 2400387 | 7/1975 | Fed. Rep. of Germany | 401/30 |
| 2143781 | 2/1985 | United Kingdom | 401/29 |

*Primary Examiner*—Steven A. Bratlie

*Attorney, Agent, or Firm*—Sherman anad Shalloway

[57] ABSTRACT

In a writing utensil according to the present invention, when a rearward outer cylinder is rotated in either direction, a cam engaging projection, which is integral with the rearward outer cylinder, slides pressingly on either of the respective cam surfaces of first and second sliders. This causes one of the first and second sliders to advance, which in turn causes a first of the first and second refills to project forwardly while the other remains retracted. Similarly, when the rearward outer cylinder is rotated in the opposite direction, the cam engaging projection slides pressingly on the other of the cam surfaces of the first and second sliders. This causes advancement of the other of the sliders, and in turn causes the second of the first and second refills to be projected while the first remains retracted. The construction allows these operations to be smoothly, stably and positively performed.

3 Claims, 30 Drawing Sheets

FIG. 46
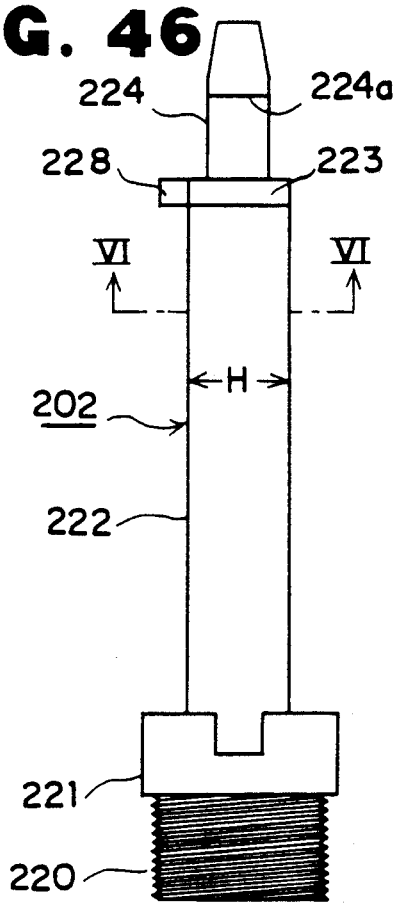
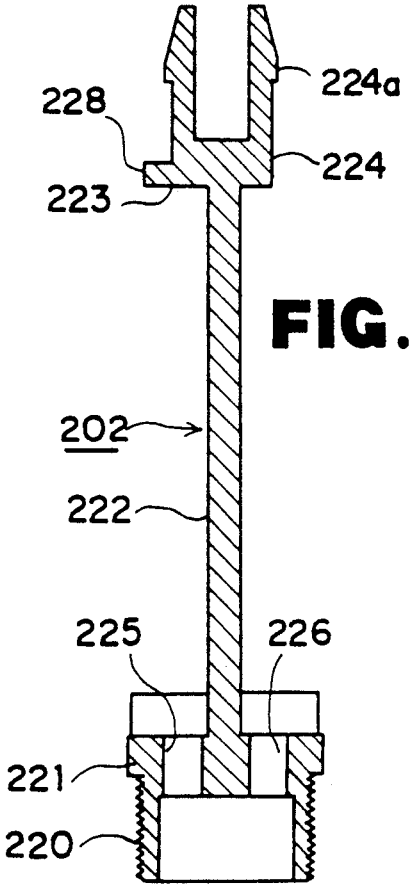
FIG. 47
FIG. 45
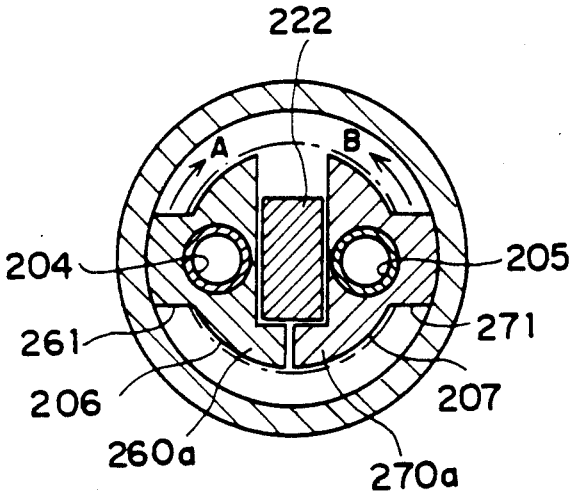
FIG. 48
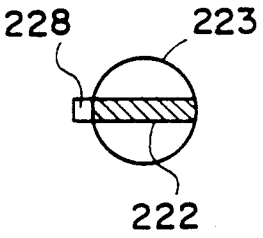

DUAL REFILL-TYPE WRITING UTENSIL

This application is a continuation of application Ser. No. 268,478, filed Nov. 8, 1988, which is a continuation of Ser. No. 006,070, filed Jan. 22, 1987, both now abandoned.

BACKGROUND OF THE INVENTION

1. Field Of The Invention

This invention relates to a dual refill-type writing utensil provided with first and second refills, which may be, for example, a mechanical pencil wherein two types of leads having different diameters are used, or a combined writing utensil of a mechanical pen and a ball-point pen, or the like, and more particularly to an improvement for such a writing utensil provided with sliders and a cam cylinder for alternately projecting and retracting the first and second refills.

2. Description of the Prior Art

A conventional writing utensil of such type as described above comprises a sheath connected to the rear end of a forward outer cylinder, to which is attached slidably a mechanical pencil holder and a ball point pen-holder, a rearward outer cylinder connected rotatably to the rear end of said forward outer cylinder through said sheath, and a cam cylinder meshed rotatably with said sheath. The mechanical pencil holder and the ball point pen-holder are arranged so as to be alternately projected and retracted from the forward end of the forward outer cylinder by means of the cam cylinder which is rotated simultaneously with the rearward outer cylinder.

In the conventional writing utensil described above, since a cam cylinder separate from its mechanical pencil holder and ball point pen-holder is required, the number of parts is increased, and the construction of a writing utensil becomes complicated and expensive. In turn, assembly of the parts is more complicated, and productivity is correspondingly lowered.

Furthermore, because of the construction of the cam cylinder; the writing utensil was necessarily of a large diameter.

Another conventional writing utensil comprises a sheath, connected to the rear end of an outer cylinder, to which is slidably attached a mechanical pencil holder and a ball point pen-holder, a cap connected rotatably to the rear end of said outer cylinder through said sheath, and a cam cylinder rotatably fitted to and supported by a sheath shaft of said sheath. The mechanical pencil holder and the ball point pen-holder are arranged so as to be alternately projected and retracted from the forward end of said outer cylinder by means of a cam cylinder rotated simultaneously with said outer cylinder.

In the conventional writing utensil described above, since its cam cylinder and sheath are separate elements, great accuracy is required in their assembly. Furthermore, play between the cam cylinder and the sheath shaft occurs during rotation and transfer thereof, so that said cam cylinder cannot be smoothly operated and the functioning of the writing utensil is deteriorated.

Furthermore, as mentioned above, since the cam cylinder and the sheath are separate elements, the number of parts is increased, and the construction of the resulting writing utensil becomes complicated. In addition, the resulting writing utensil becomes expensive, because assembly is complicated and the productivity thereof is low, because precision in assembly is necessary.

Another conventional writing utensil comprises a sheath connected to the rear end of a forward outer cylinder to which are slidably attached a mechanical pencil holder and a ball point pen-holder, a cam cylinder fitted slidably into a axially slidable groove defined on a circular shaft portion (sheath shaft portion) of said sheath to be connected to the rear ends of said mechanical pencil holder and ball point pen-holder, and a rearward outer cylinder which is simultaneously rotatable with said cam cylinder and is connected rotatably and slidably to the rear end of said forward outer cylinder. The mechanical pencil holder and the ball point pen-holder are arranged so as to be alternately projected and retracted from the forward end of the forward outer cylinder by means of a cam cylinder rotated simultaneously with the rearward outer cylinder.

In the conventional writing utensil described above, since sliders integral with the rear end of the pen-holder are slidably fitted into axially slidable grooves each having a small groove width and defined on a columnar sheath shaft portion, said sliders are easily slipped out from said axially slidable grooves because of a rotational friction (rotational load), and thus the sliders are not smoothly slid by means of a rotation of a cam cylinder. As a result, there is such a problem that the alternate projection and retraction of the mechanical pencil holder as well as ball point pen-holder cannot be smoothly carried out.

Furthermore, since said sheath shaft portion is formed into a columnar shape, the outer cylinder of the writing utensil must be of a large diameter, thereby causing the outer diameter of the writing utensil to be of a large diameter.

SUMMARY OF THE INVENTION

The present invention is constructed so as to overcome the above described problems, and an object of the invention is to obtain a writing utensil which requires no separate conventional cam cylinder so that the number of parts is decreased and the whole construction of the writing utensil becomes simple. It is also an object to provide smooth and positive alternate projection and retraction of first and second refills upon rotation of a rearward outer cylinder.

Furthermore, another object of the present invention is to provide a writing utensil which has an integral structure of a cam cylinder with a sheath shaft or a cap so that there is no play therebetween during rotation and transfer of said cam cylinder, such that said cam cylinder can be smoothly operated, smooth and positive operations of the refills can be attained, and the number of parts may be reduced. Moreover, the writing utensil of the present invention can be simply and easily assembled, the productivity therefor can be improved and the cost therefor can be reduced, and the refills thereof can be smoothly projected and retracted by a rotation of a clip engaged with the sheath shaft.

A still further object of the present invention is to provide a writing utensil wherein sliders can be smoothly and stably slid along a sheath shaft portion by means of a cam cylinder rotating integrally with a rearward outer cylinder so that the sliders are prevented from slipping off from said sheath shaft portion during sliding thereof, and whereby refills are smoothly and positively projected and retracted.

In a writing utensil according to the present invention, a sheath is detachably connected to the rear end portion of a forward outer cylinder, first and second refills are mounted slidably along the axial direction thereof within the sheath, sliders are integrally connected to the rear ends of said first and second refills, and cam surfaces defined on these sliders are selectively engaged forcibly with a cam engaging projection formed on the inner circumference of said rearward outer cylinder.

In a writing utensil according to the present invention, a cam cylinder, with which are forcibly engaged the respective rear ends of first and second refills, is integrally constructed with a sheath shaft disposed in said cam cylinder and extending forwardly, and the aforesaid refills are projected and retracted by rotating a clip engaged with the sheath shaft.

In a writing utensil according to the present invention, a sheath, connected detachably to the rear end portion of a forward outer cylinder and to which are slidably attached first and second refills, is formed into a flat plate. Hooking leg portions, which engage with side surfaces of said sheath, are provided on a side upon which a rotation load of a rearward outer cylinder acts when a refill of a slider, which is integrally connected to the rear ends of said first and second refills to be slidably contacted with said sheath, is projected.

In a writing utensil according to the present invention, a cap is rotatably and detachably connected to the rear end of an outer cylinder into which is axially slidably inserted first and second refills, a cam cylinder, mounted on said cap in a synchronously rotatable manner and with which are forcibly engaged the respective rear ends of said first and second refills, is integrally constructed with a sheath shaft disposed in said cam cylinder and extending forwardly. Said sheath shaft is slidably and axially inserted into a guide means into which are slidably and axially inserted said first and second refills in said outer cylinder.

BRIEF DESCRIPTION OF THE DRAWING FIGURES

Figure 1:
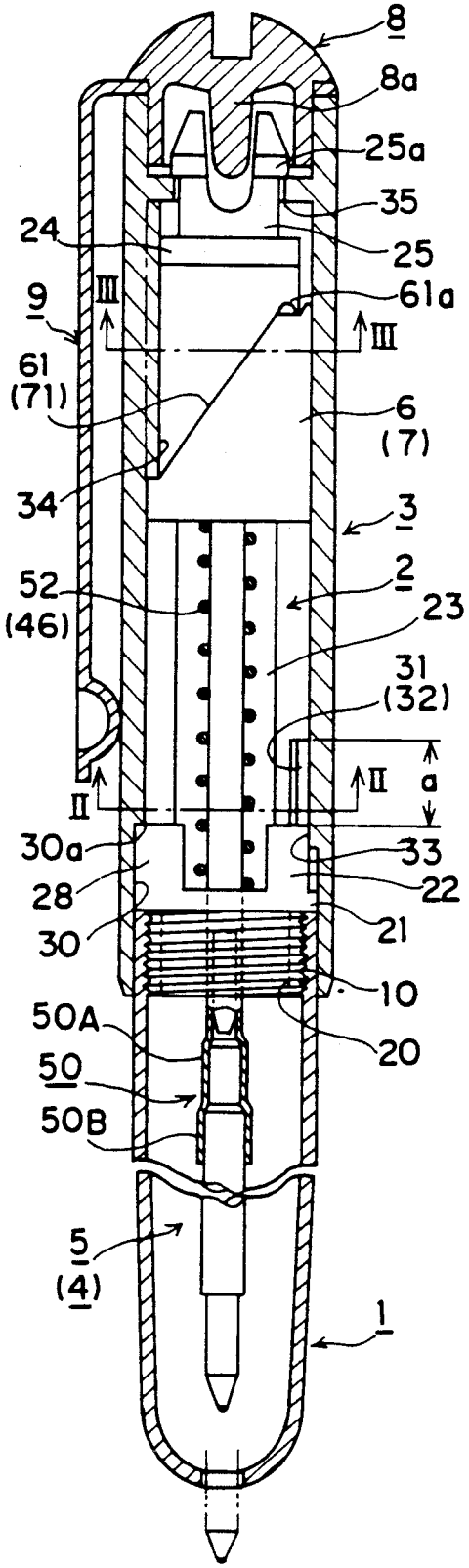
FIG. 1 is a sectional view showing a writing utensil according to an embodiment of the present invention.
Figure 11A:
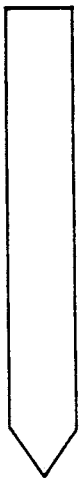
Figure 13:
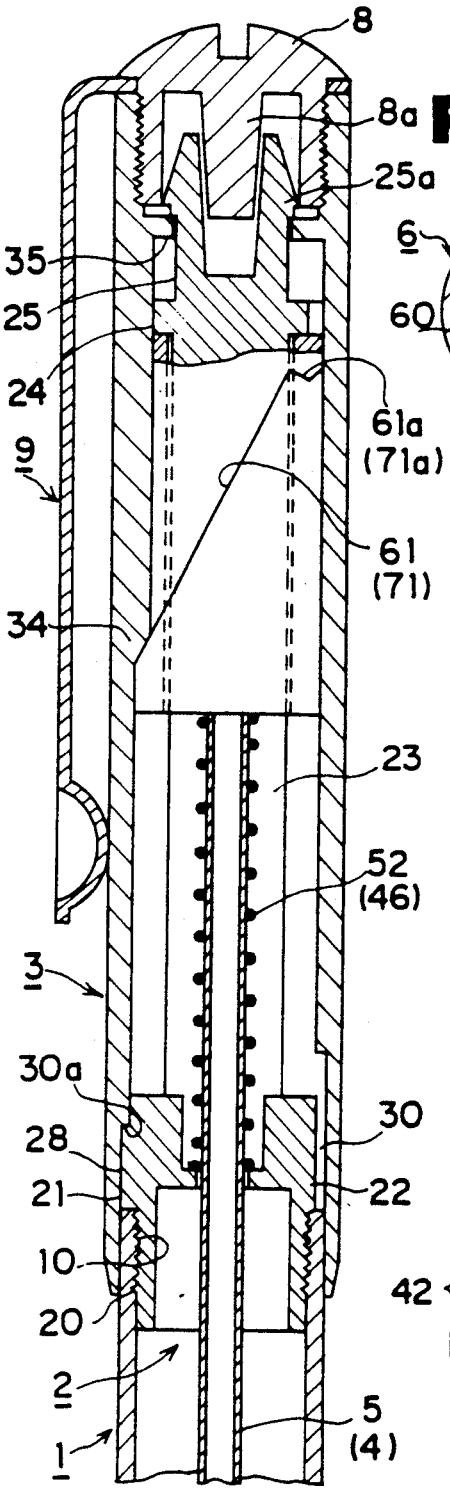
Figure 14:
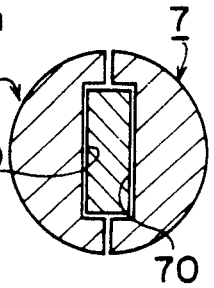
Figure 12:
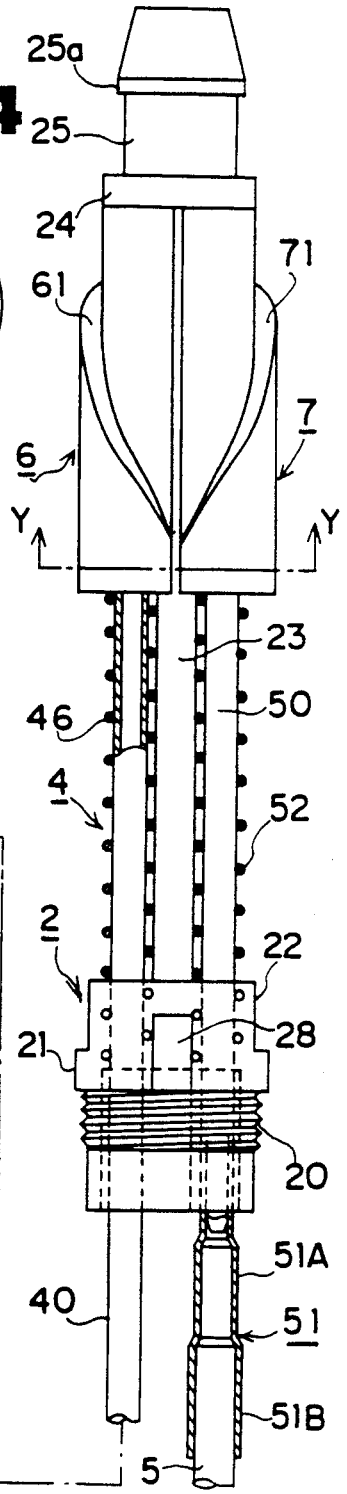
Figure 15:
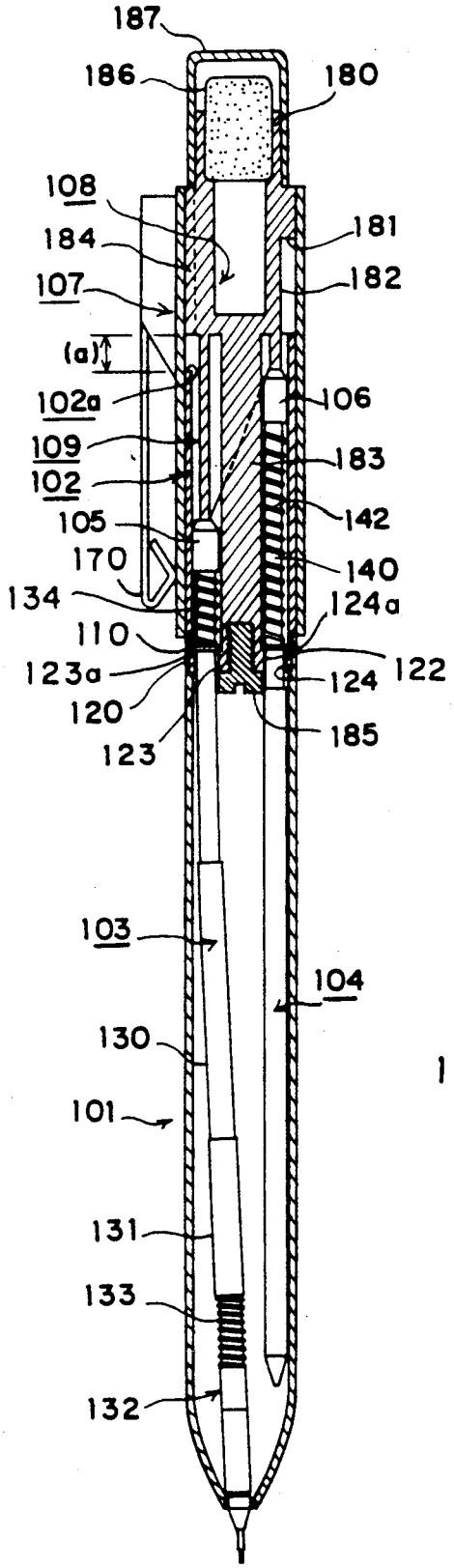
Figure 16:
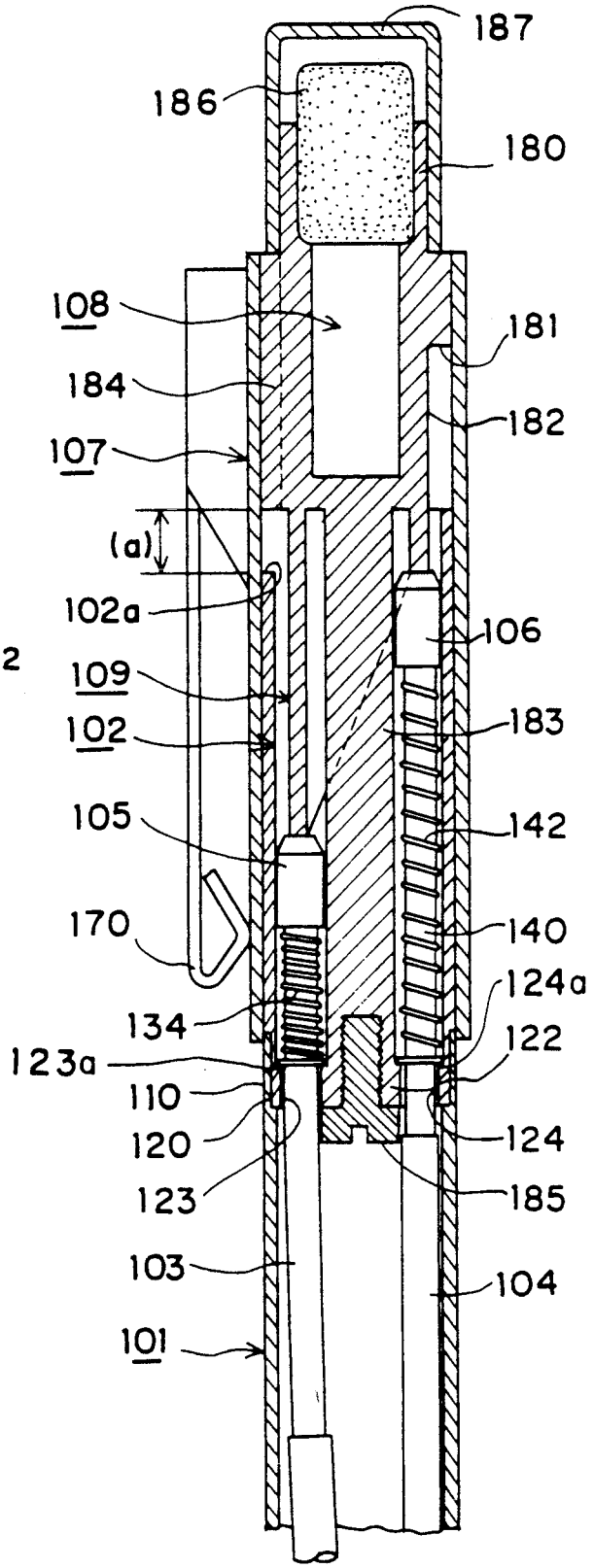
Figure 17:
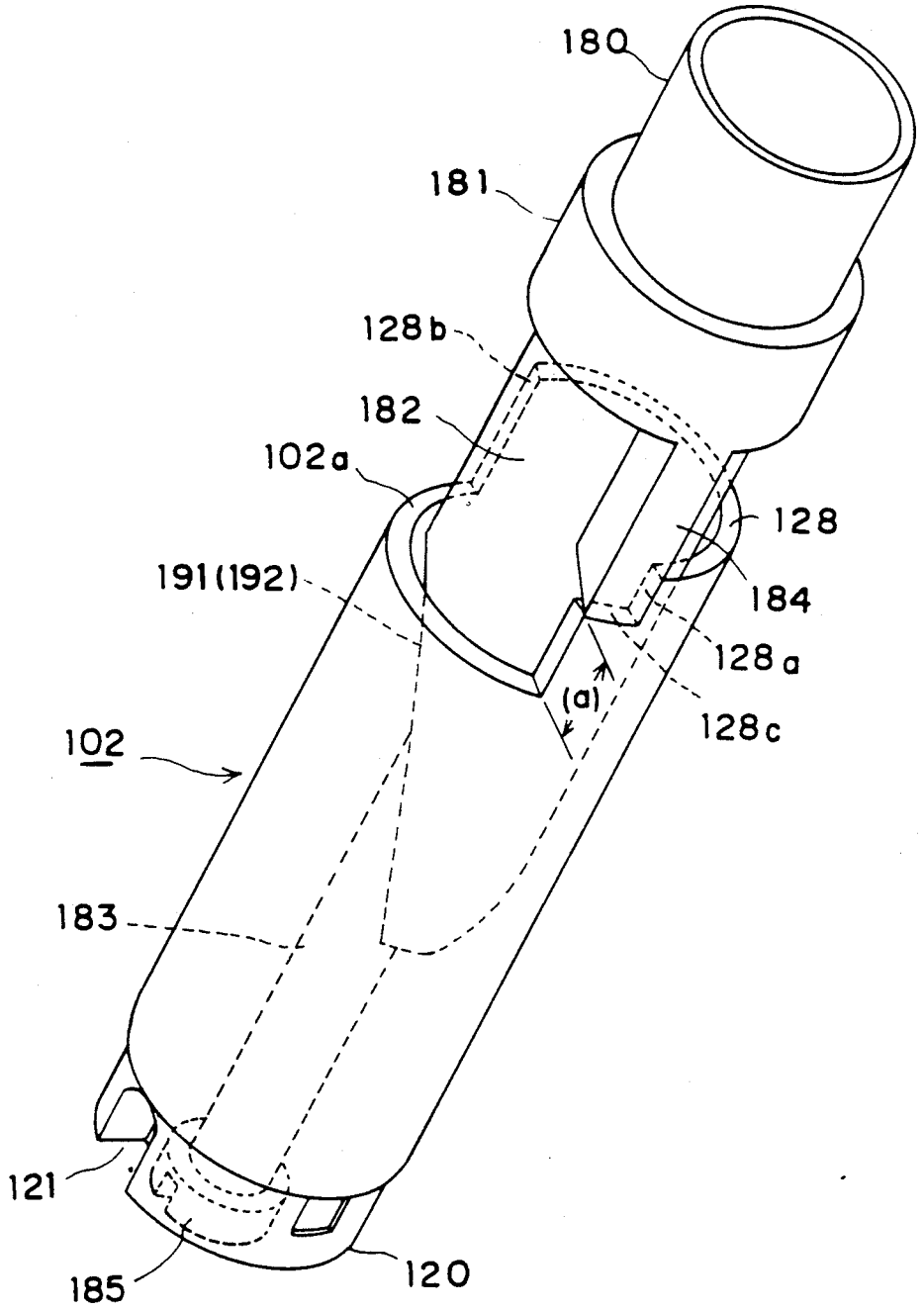
Figure 23:
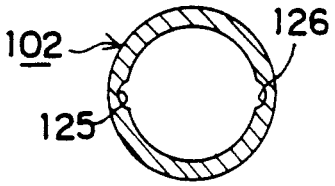
Figure 18:
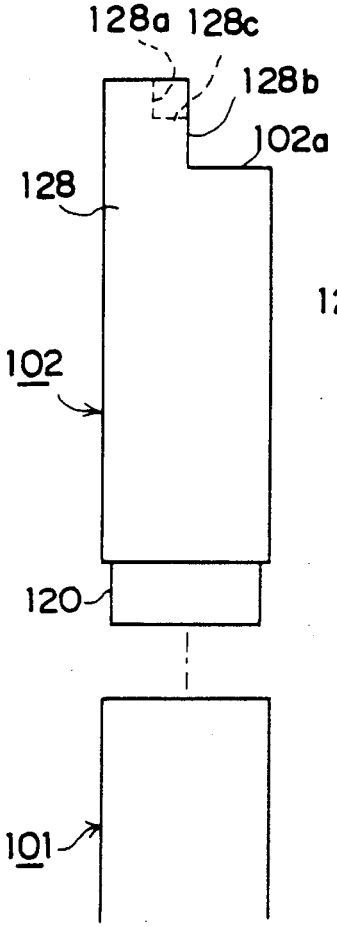
Figure 19:
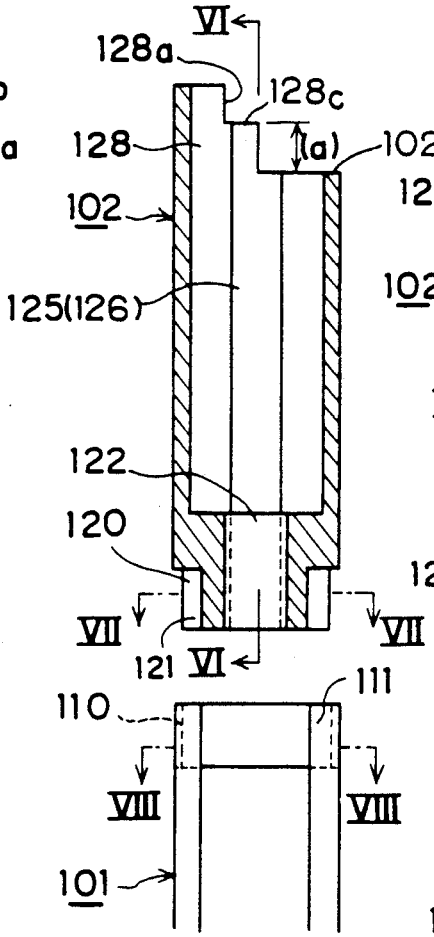
Figure 20:
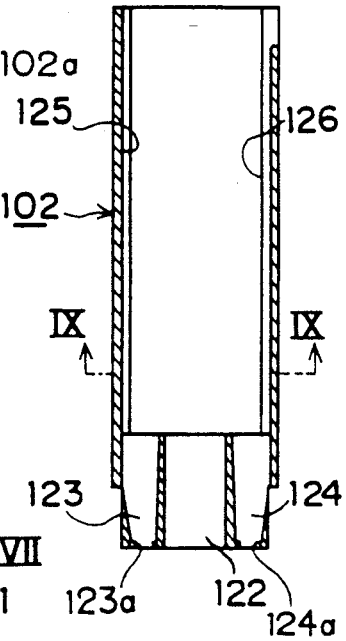
Figure 22:
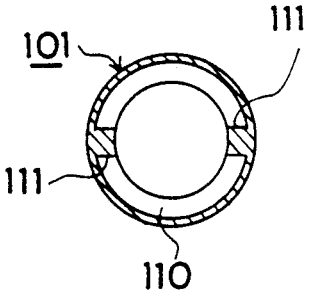
Figure 21:
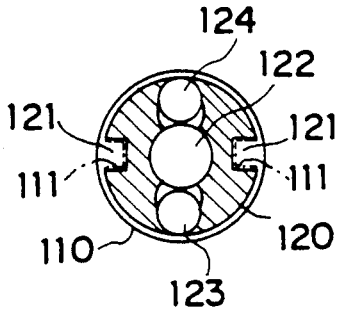
Figure 25:
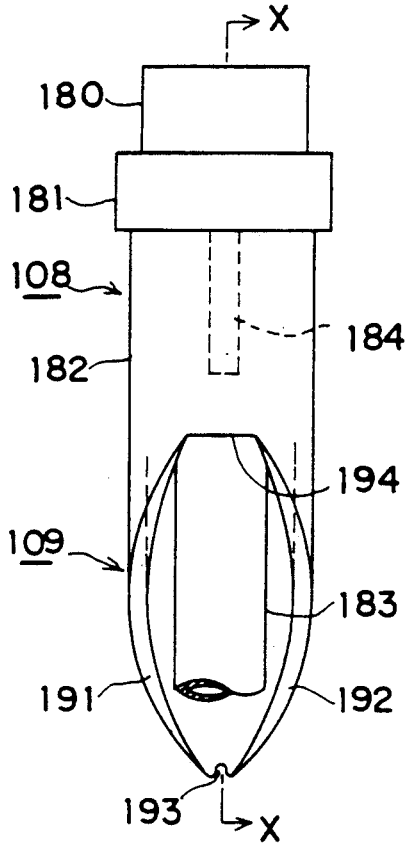
Figure 26:
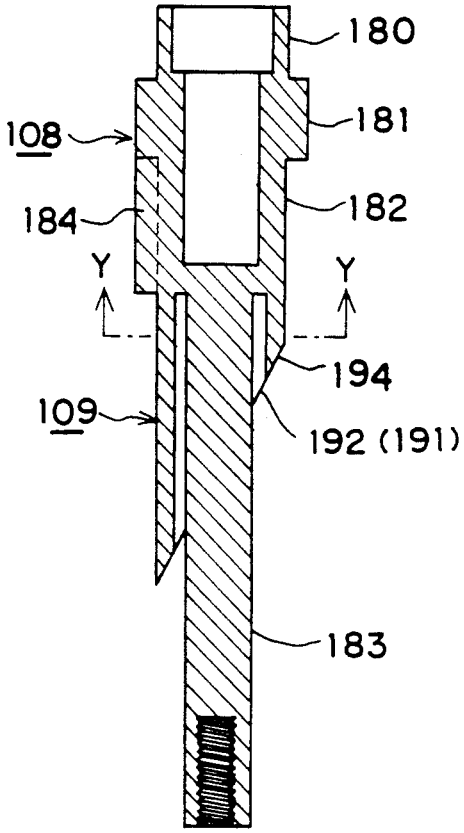
Figure 24:
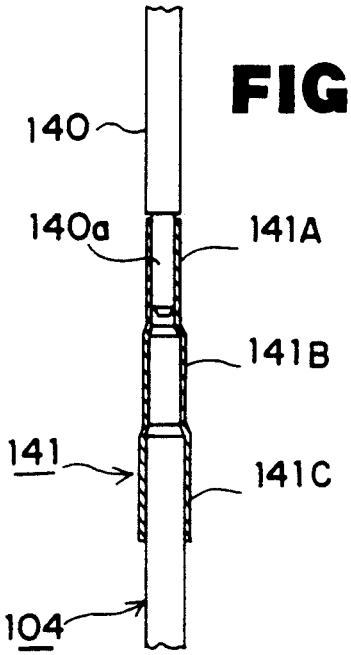
Figure 27:
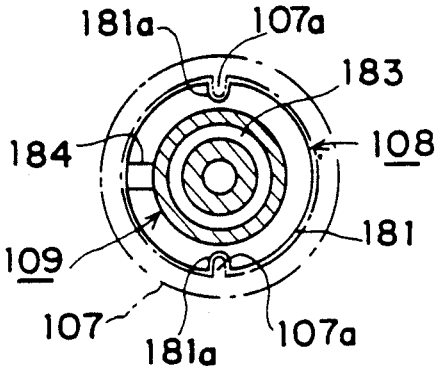
Figure 28:
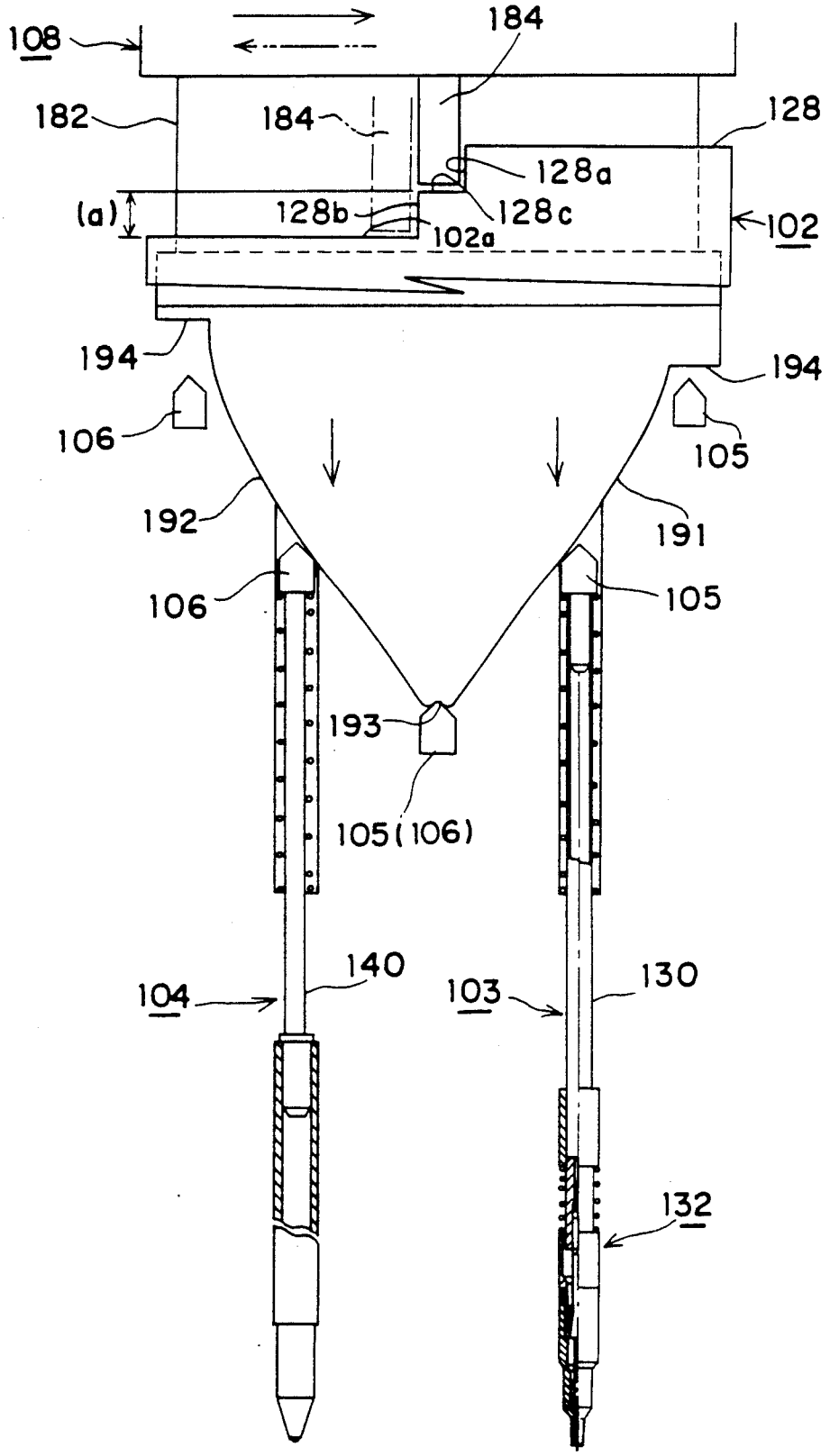
Figure 29:
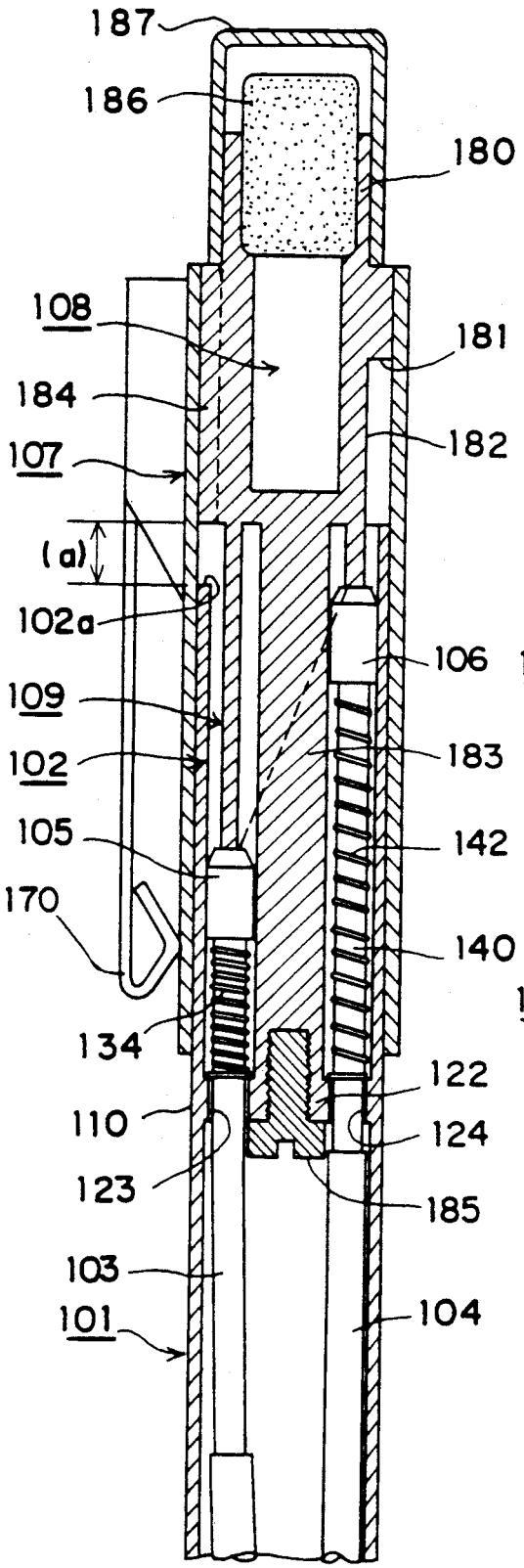
Figure 30:
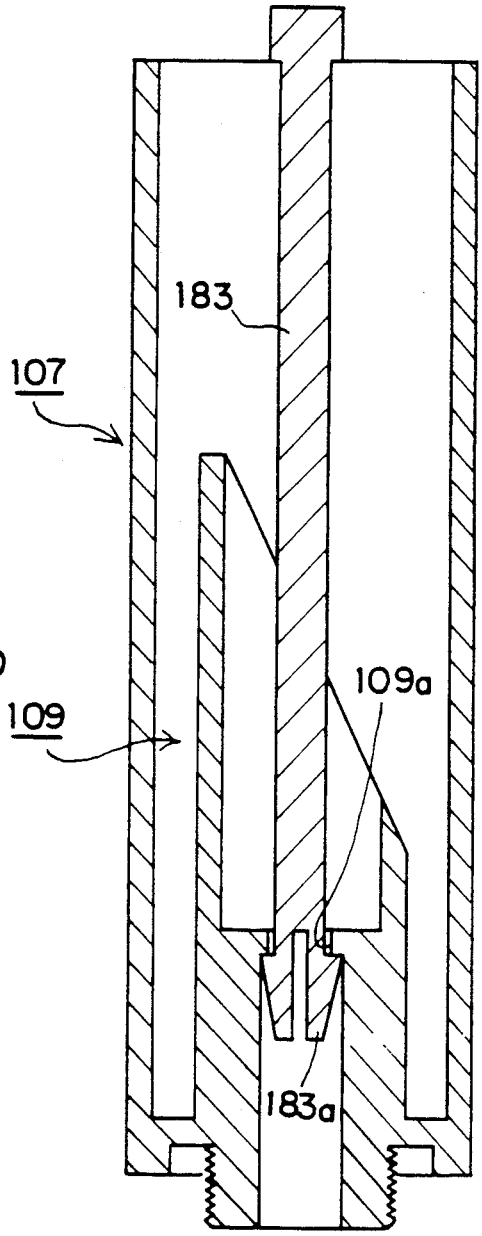
Figure 31:
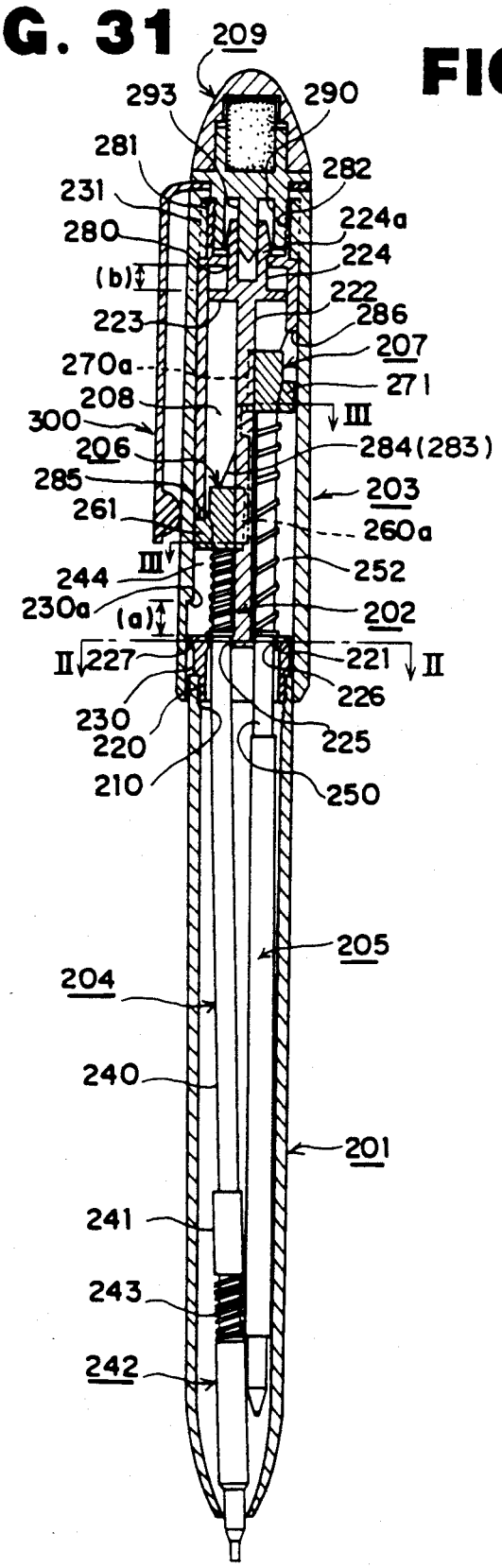
Figure 32:
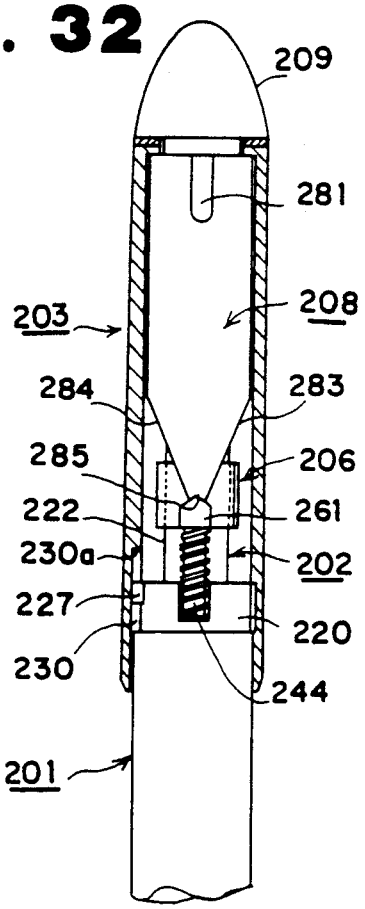
Figure 33:
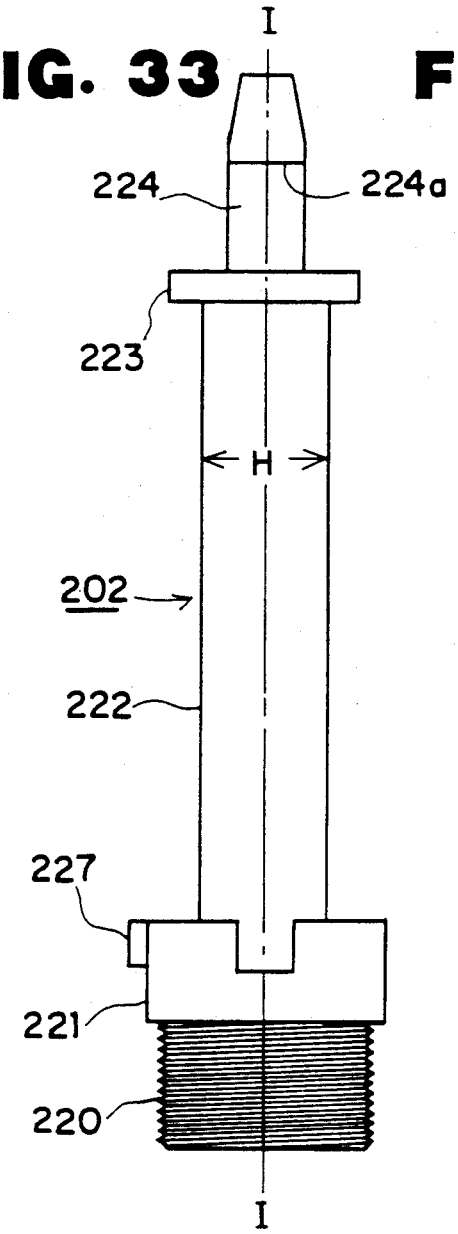
Figure 34:
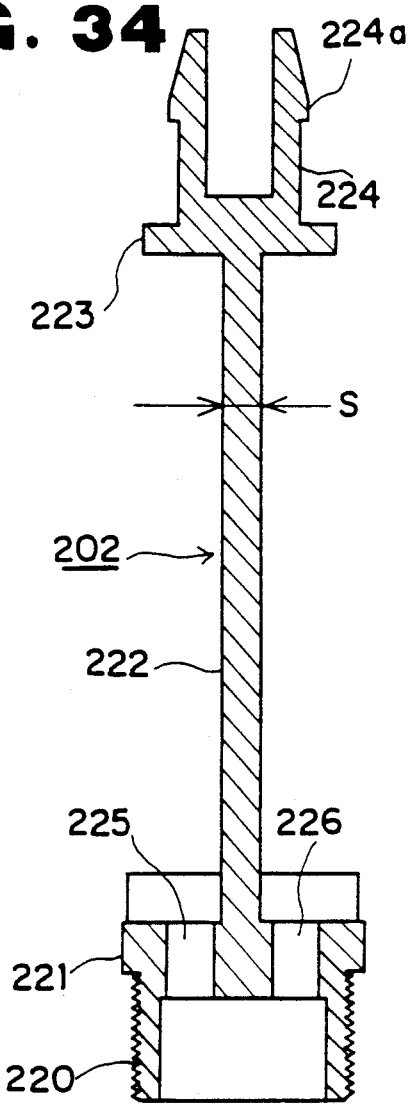
Figure 35:
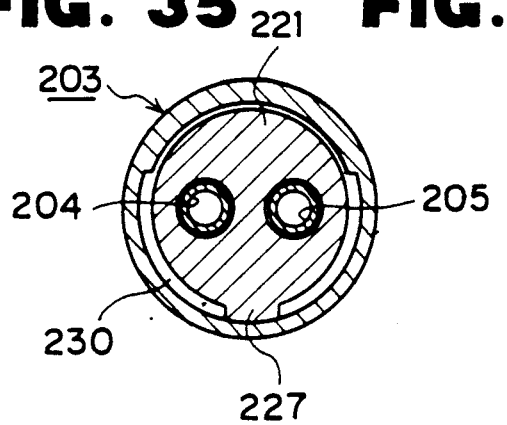
Figure 36:
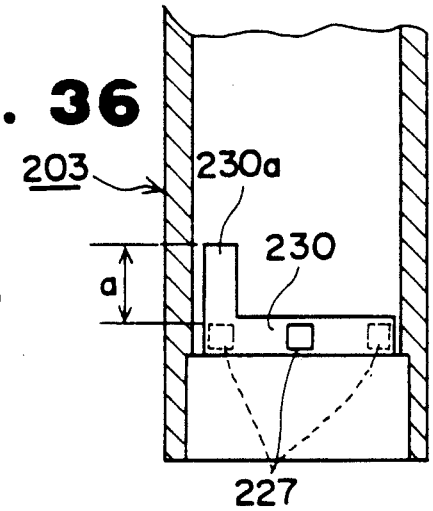
Figure 37:
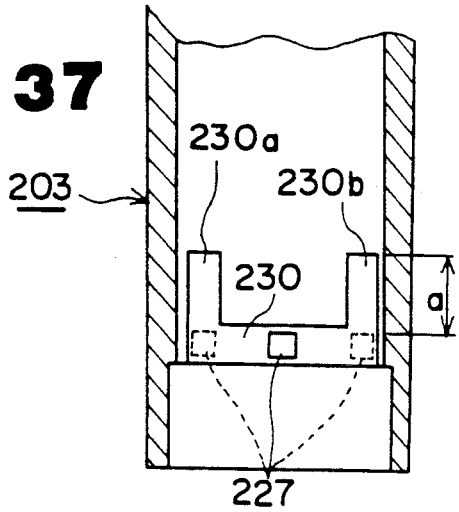

FIGS. 11(A) and (B) are views illustrating different modifications of a cam engaging projection, respectively;

FIG. 12 is a plan view, partly in section, showing an internal unit construction of a writing utensil;

FIG. 13 is an enlarged sectional view of FIG. 1 on the side of the rearward outer cylinder;

FIG. 14 is a sectional view taken along the line Y—Y of FIG. 12;

FIG. 15 is a sectional view showing the writing utensil according to another embodiment of the present invention;

FIG. 16 is a partially sectional view of FIG. 15 wherein parts other than the outer cylinder and the junction outer cylinder are coaxially arranged;

FIG. 17 is a perspective illustration of a junction outer cylinder in FIG. 16;

FIG. 18 is an exploded front view of an outer cylinder 101 and a junction outer cylinder in FIG. 16;

FIG. 19 is a sectional view of the junction outer cylinder in FIG. 18;

FIG. 20 is a sectional view taken along the line VI—VI of FIG. 19;

FIG. 21 is a sectional view taken along the line VII—VII of FIG. 19;

FIG. 22 is a sectional view taken along the line VIII—VIII of FIG. 19;

FIG. 23 is a sectional view taken along the line IX—IX of FIG. 20;

FIG. 24 is a schematic illustration of a pen attaching shaft shown in FIG. 15;

FIG. 25 is a plan sectional view of a sheath of the writing utensil shown in FIG. 15;

FIG. 26 is a sectional view taken along the line X—X of FIG. 25;

FIG. 27 is a sectional view taken along the line Y—Y of FIG. 26;

FIG. 28 is a developed explanatory view illustrating functions of a cam cylinder;

FIG. 29 is a sectional view showing the writing utensil according to another modified embodiment of the present invention;

FIG. 30 is a developed sectional view of a cam cylinder;

FIG. 31 is a sectional view showing the writing utensil according to another embodiment of the present invention;

FIG. 32 is a plan view of an internal mechanism showing a sectional rearward outer cylinder of the writing utensil of FIG. 31;

FIG. 33 is an enlarged plan view showing a sheath;

FIG. 34 is a sectional view taken along the line I—I of FIG. 33;

FIG. 35 is a sectional view taken along the line II—II of FIG. 31;

FIG. 36 is an explanatory view showing a mechanism for restricting a rotation of a cam cylinder;

FIG. 37 is an explanatory view illustrating another example of FIG. 36.

Figure 39:
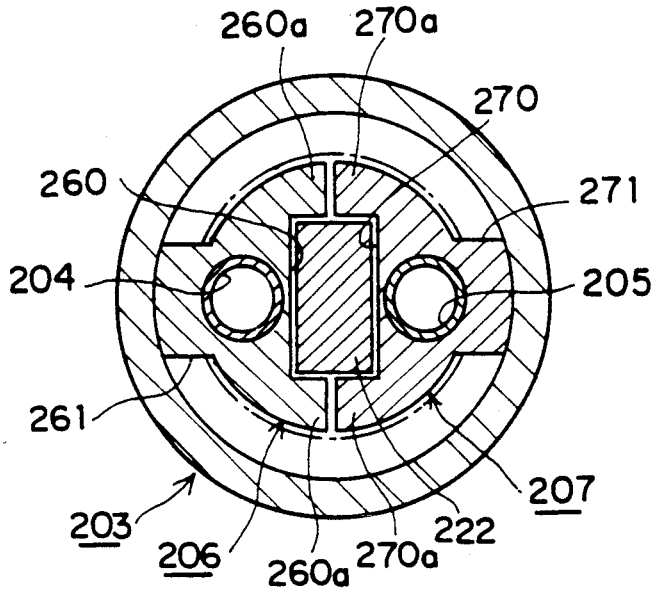
Figure 38:
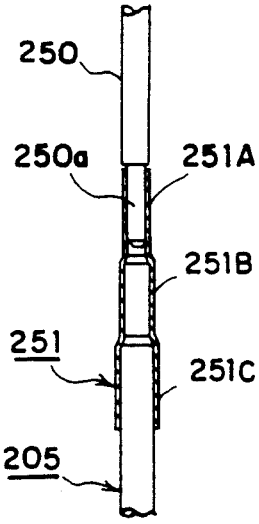
Figure 40A:
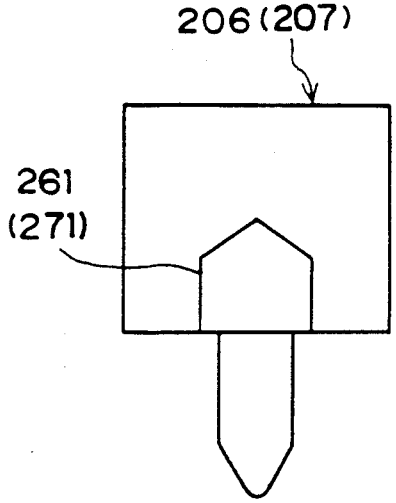
Figure 40B:
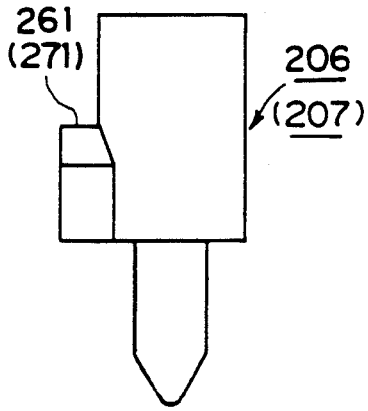
Figure 43:
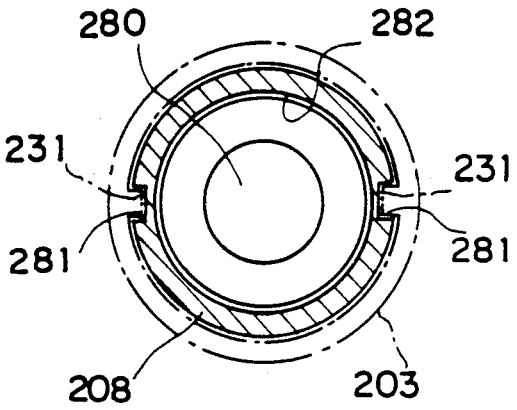
Figure 41:
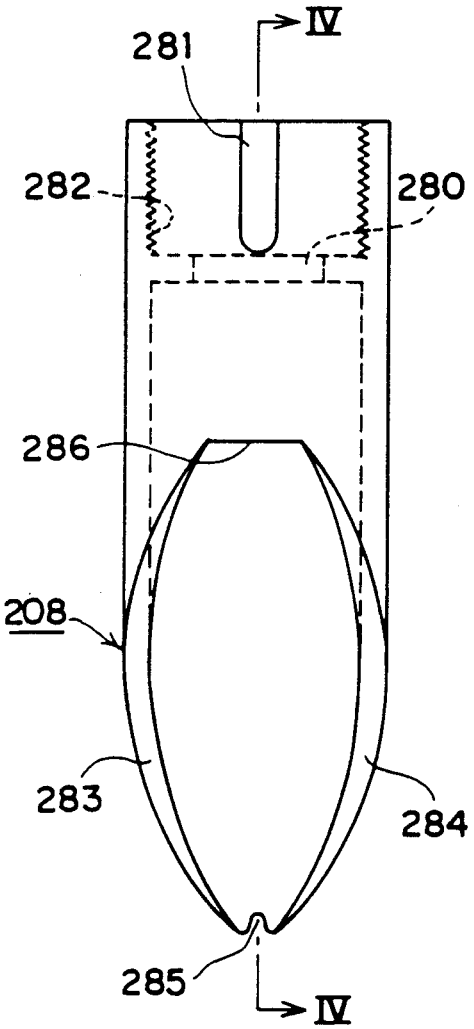
Figure 42:
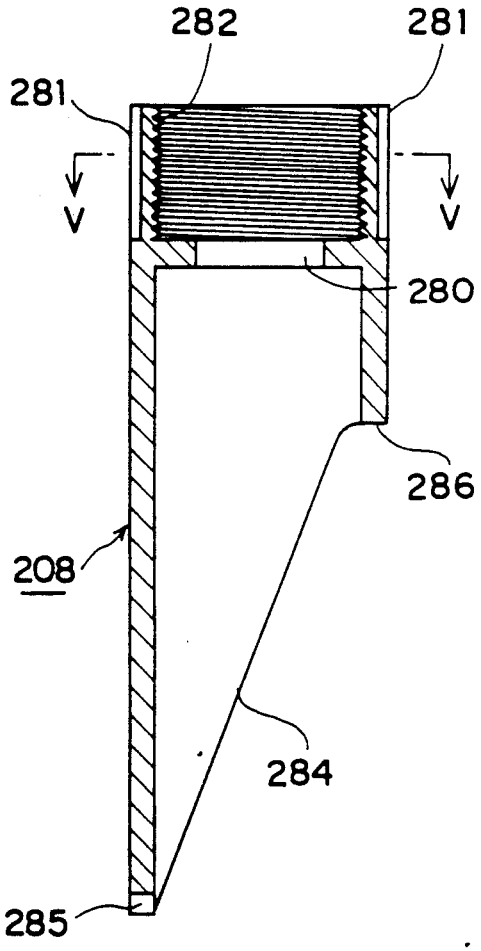
Figure 44:
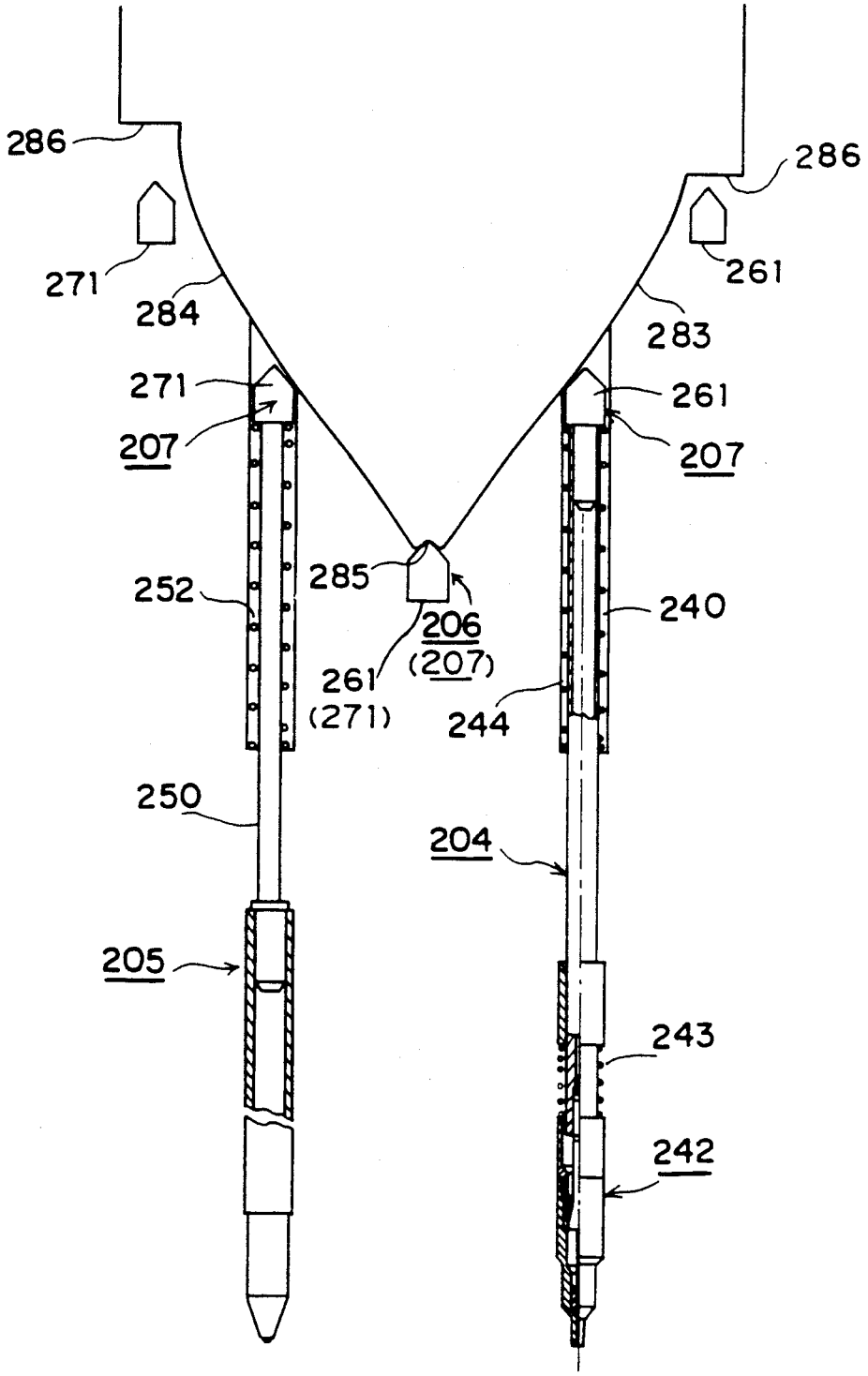
Figure 49:
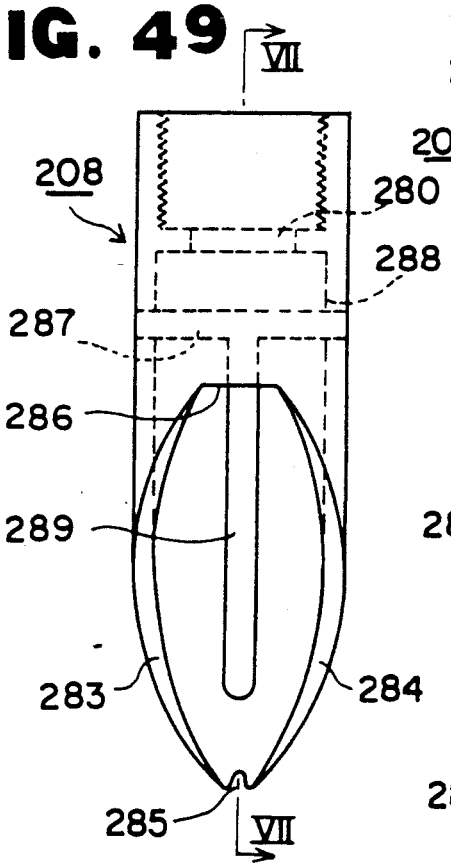
Figure 50:
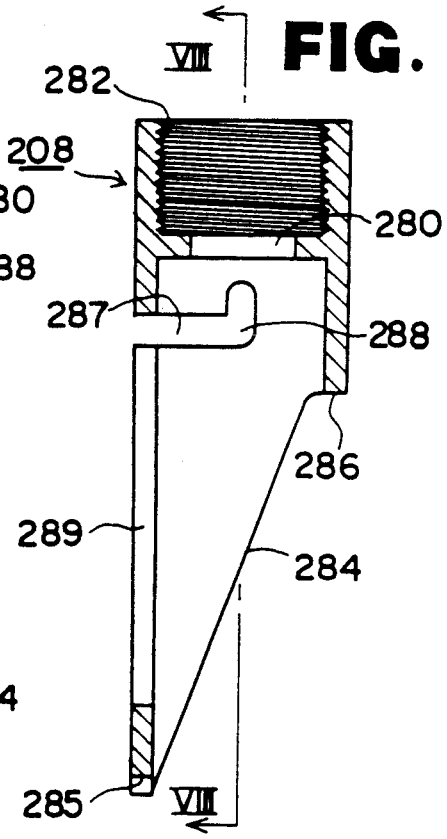
Figure 51:
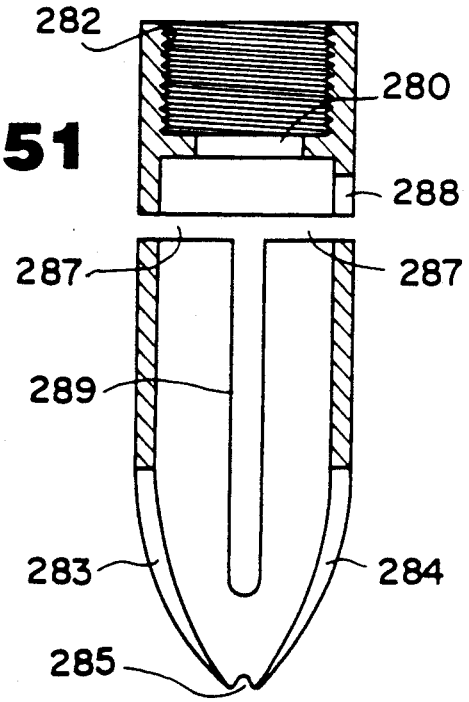
Figure 52:
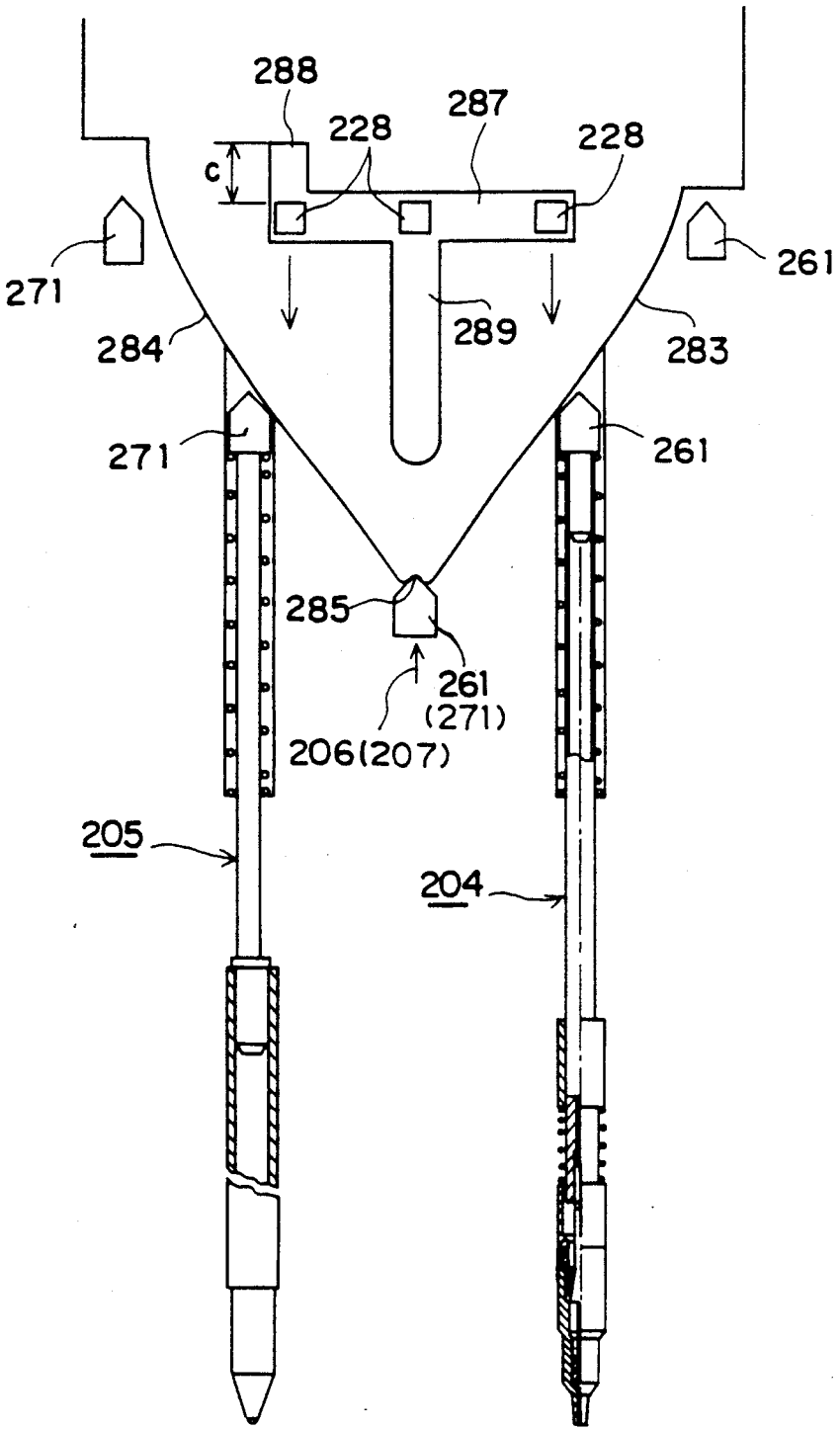
Figure 53:
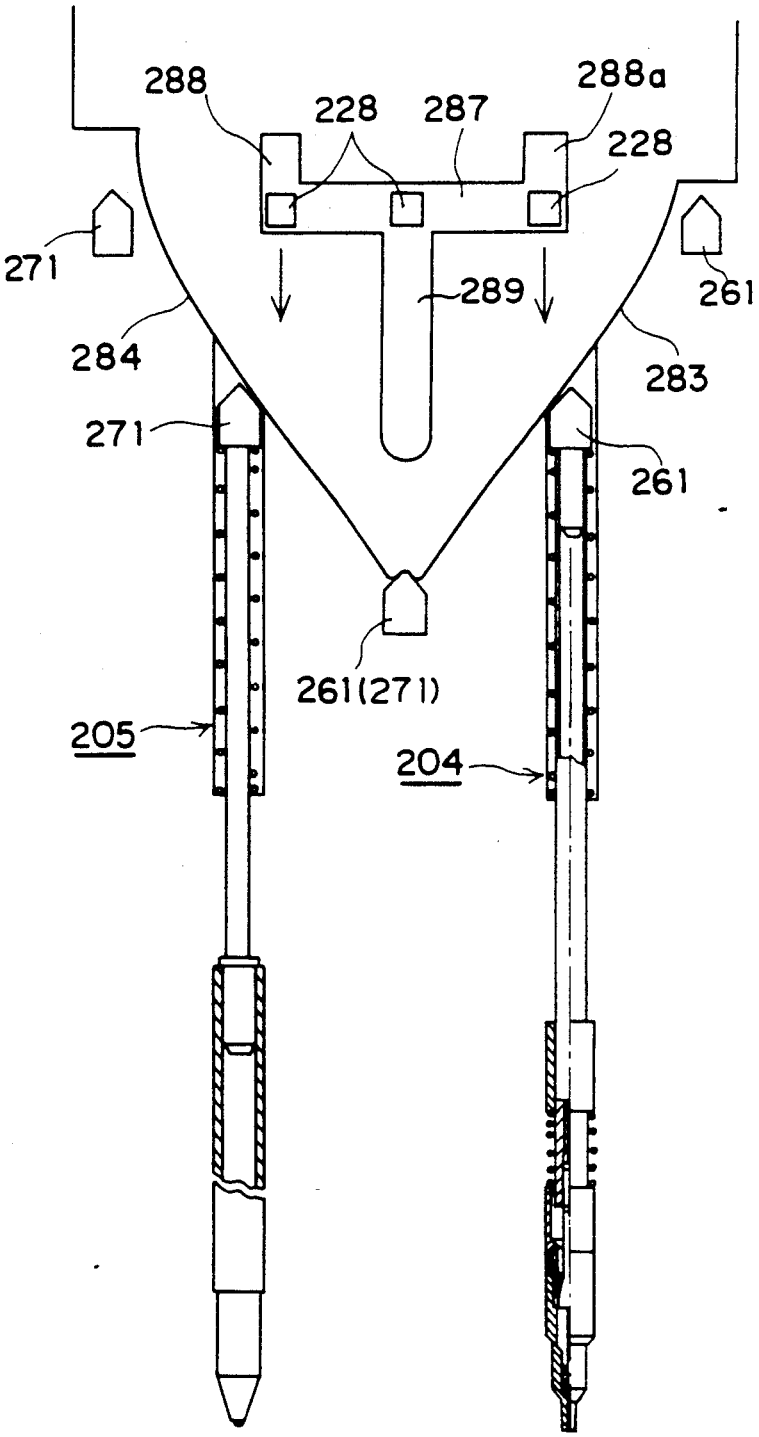
Figure 54:
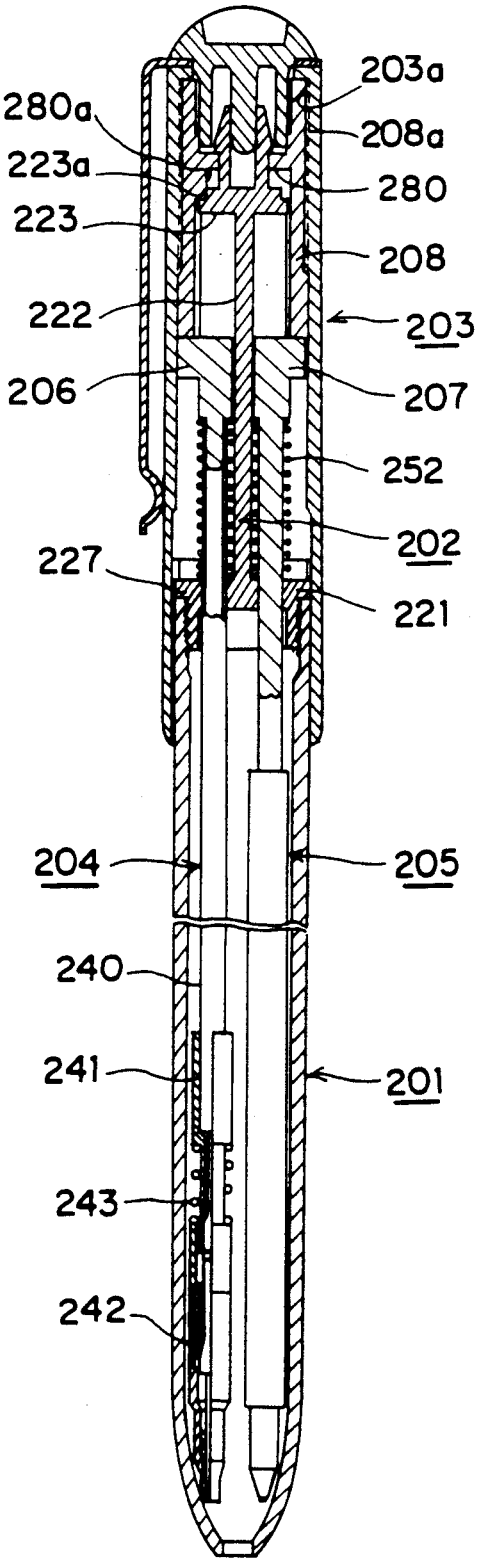
Figure 56:
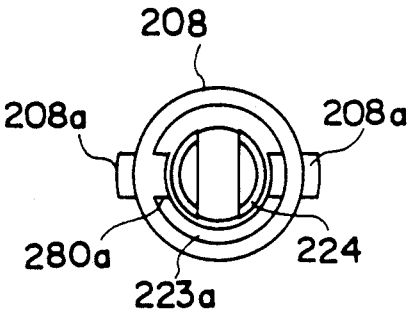
Figure 55:
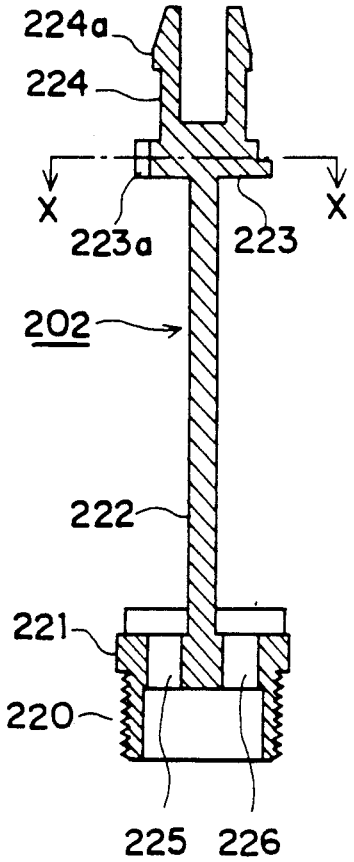
Figure 57:
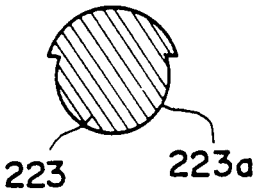
Figure 59:
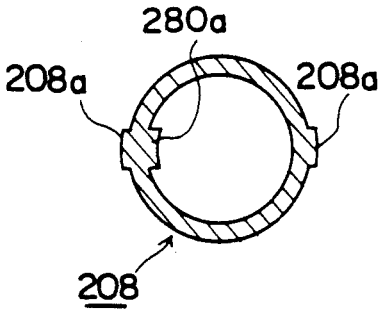
Figure 60:
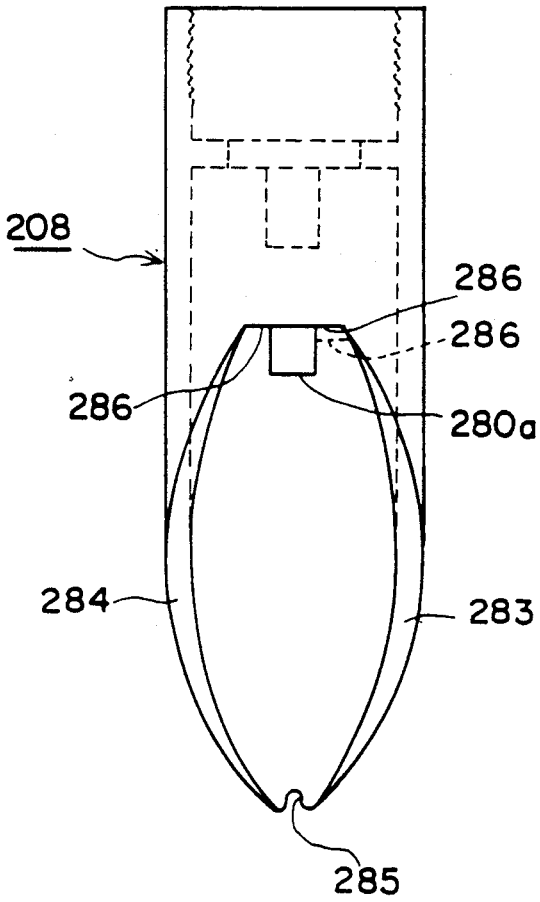
Figure 58:
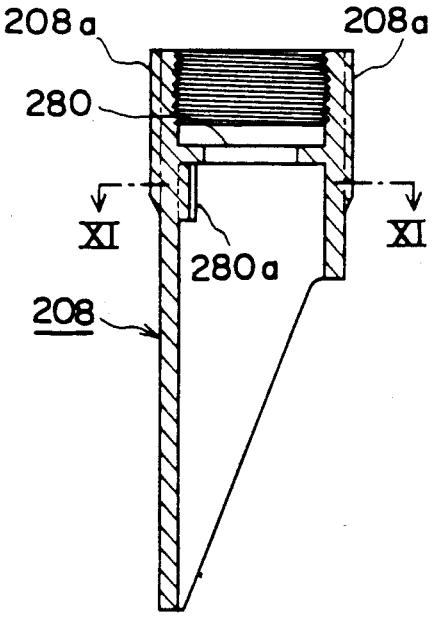
Figure 61:
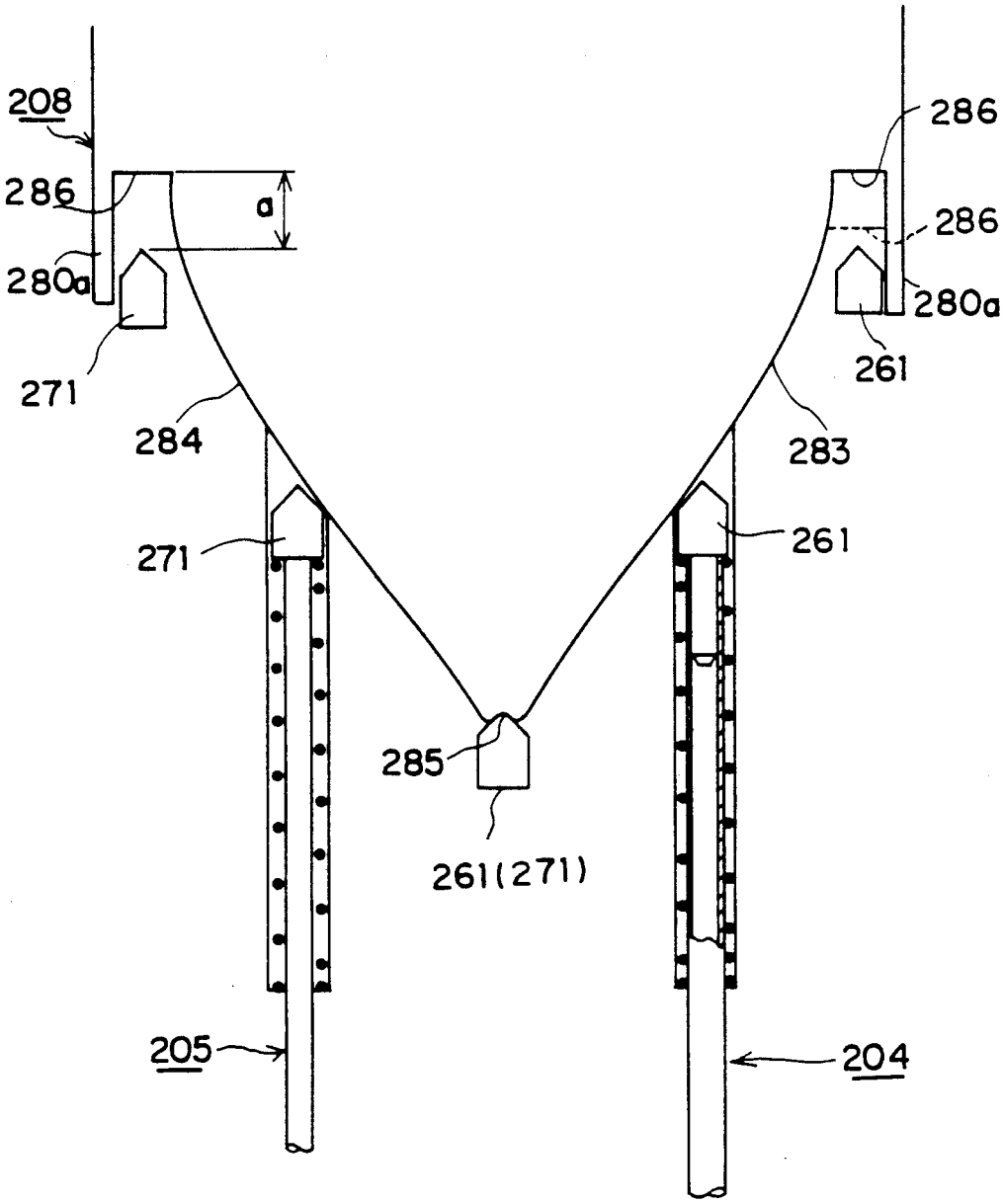
Figure 62:
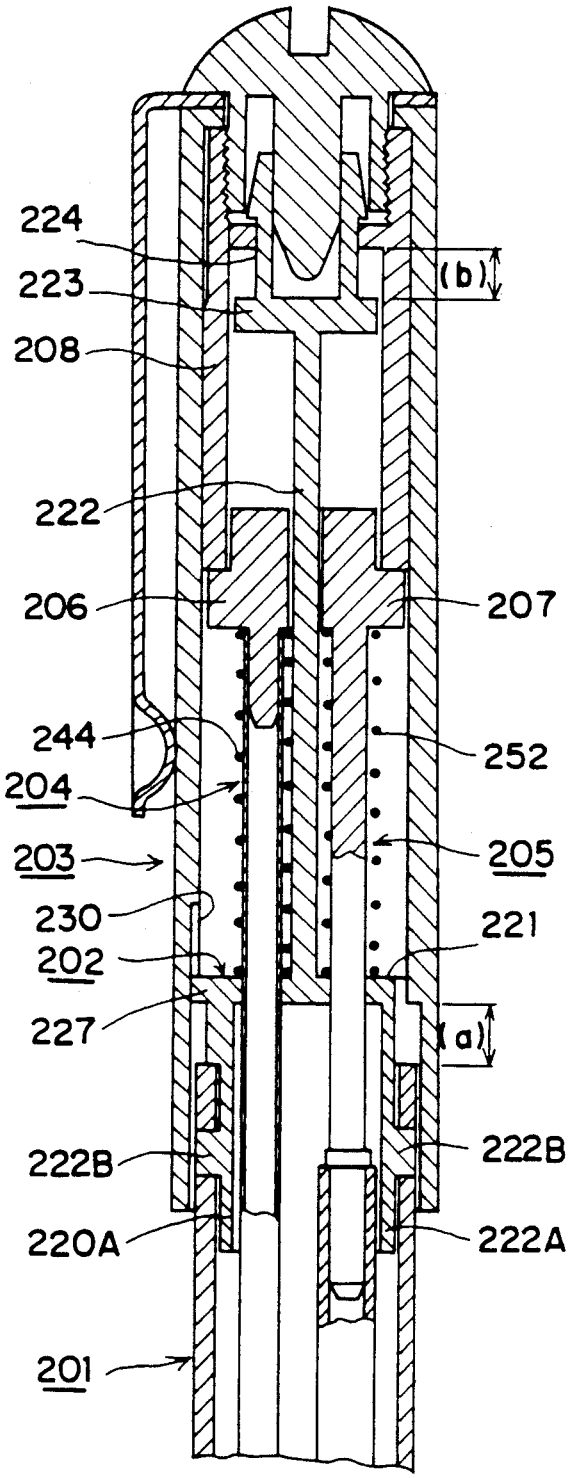
Figure 64:
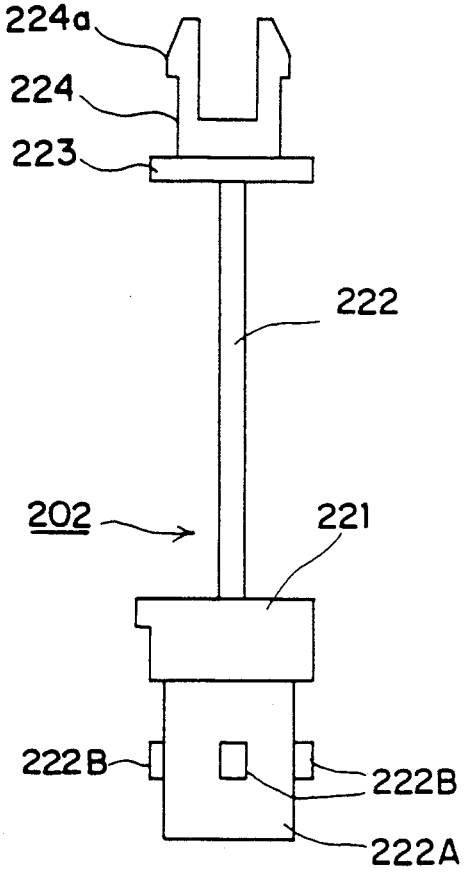
Figure 63:
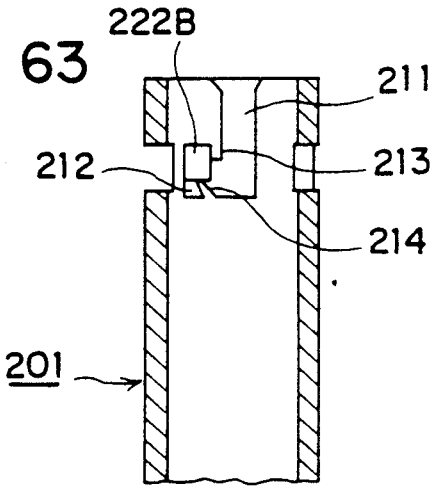
Figure 66:
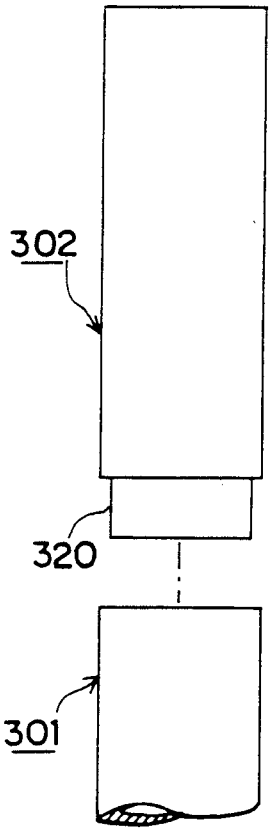
Figure 65:
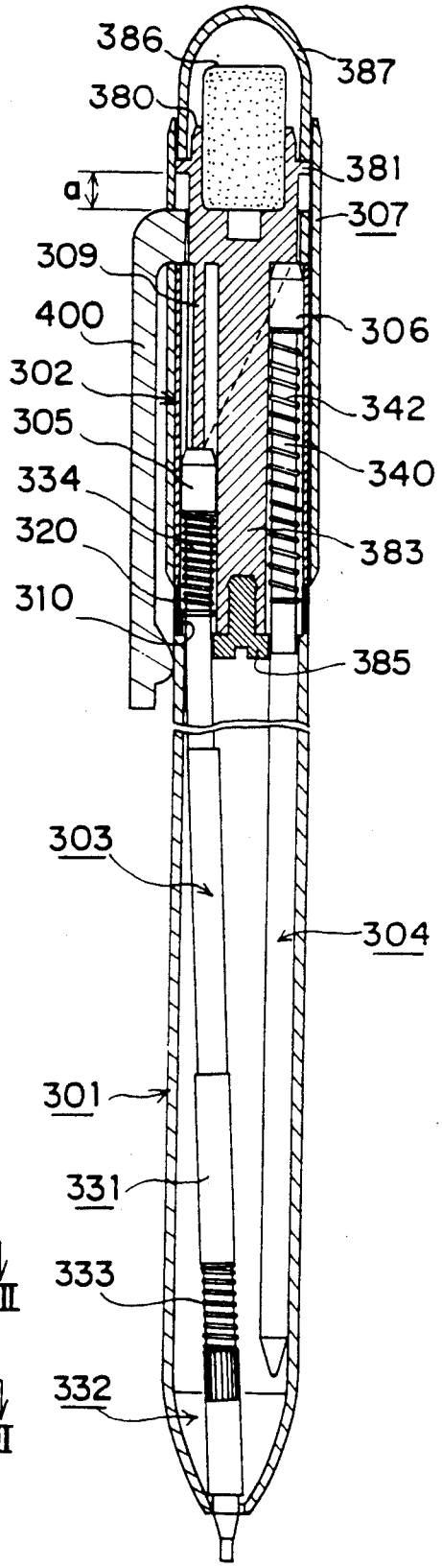
Figure 67:
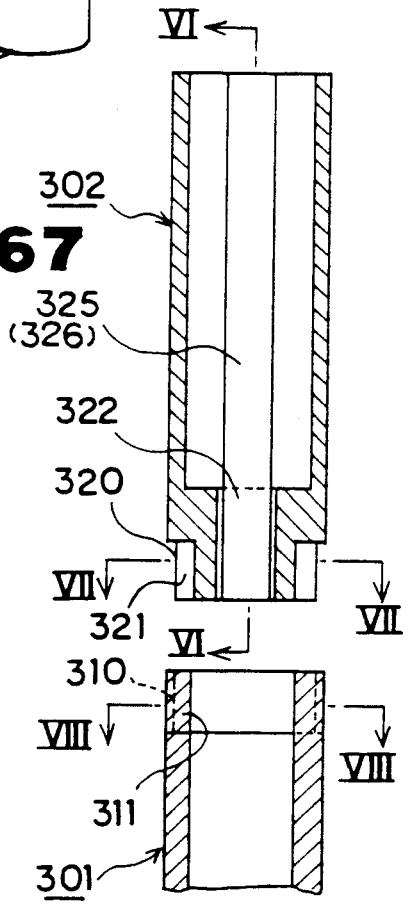
Figure 69:
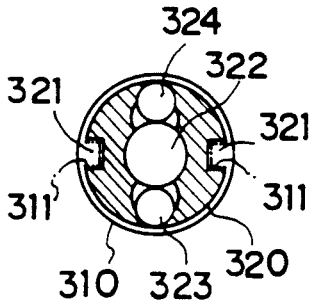
Figure 71:
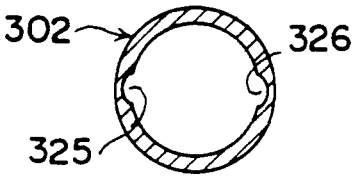
Figure 70:
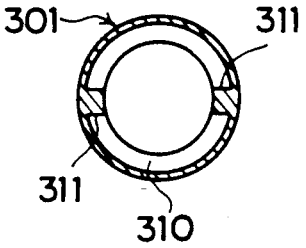
Figure 68:
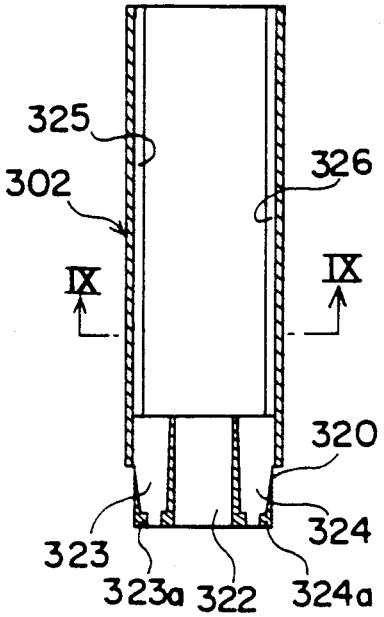
Figure 72:
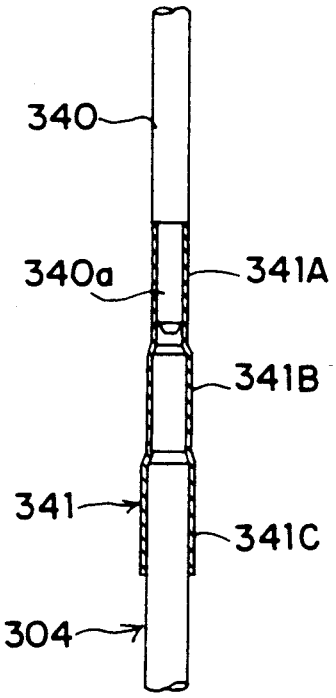
Figure 73:
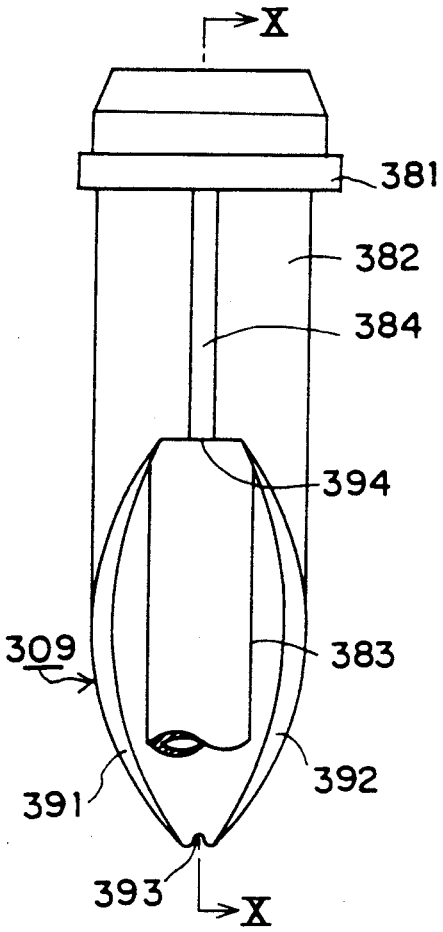
Figure 74:
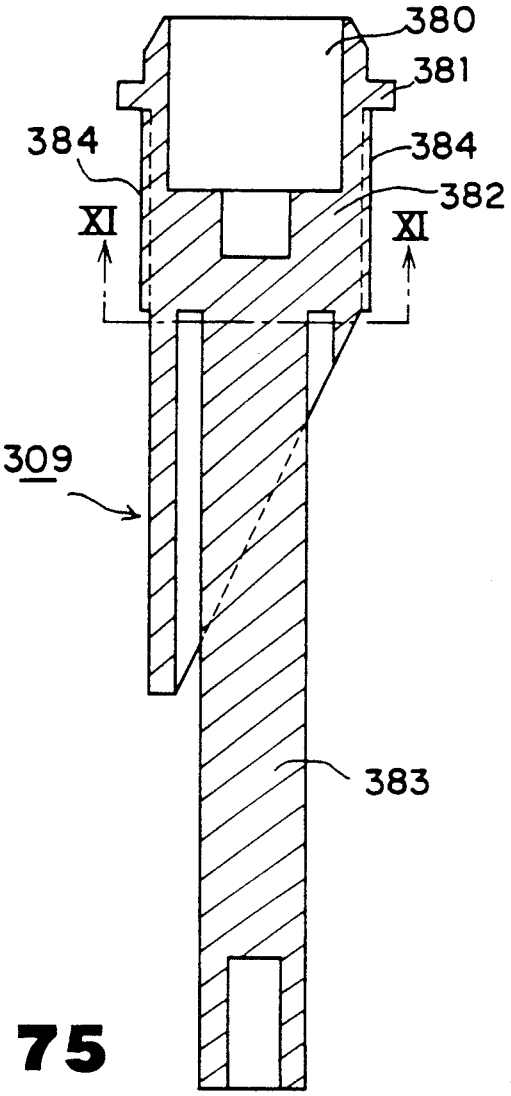
Figure 75:
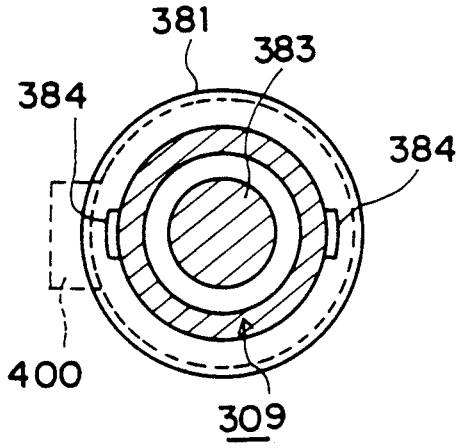
Figure 76:
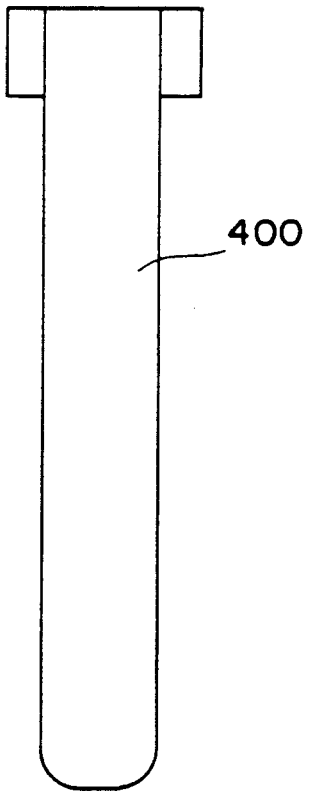
Figure 77:
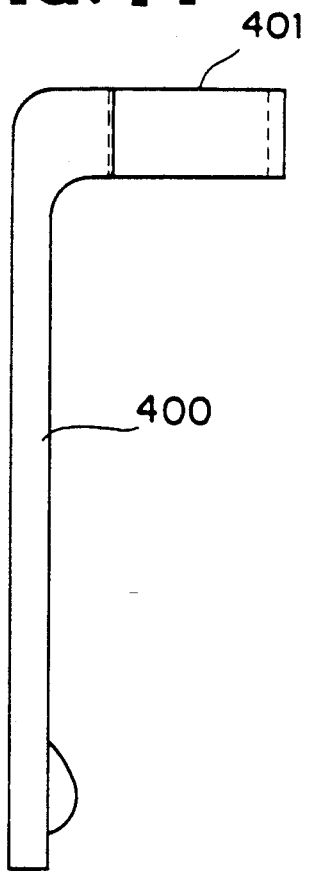
Figure 78:
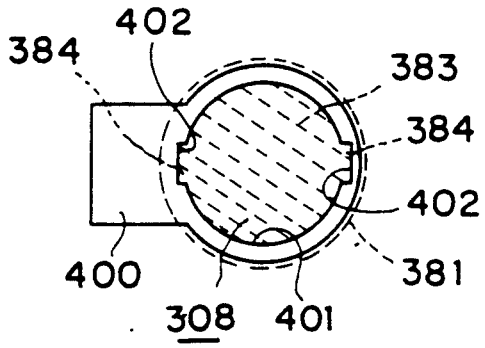
Figure 79:
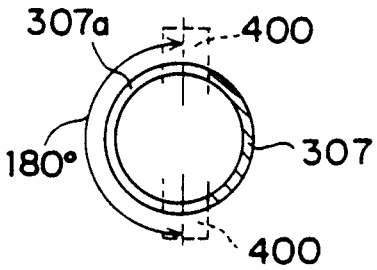
Figure 80:
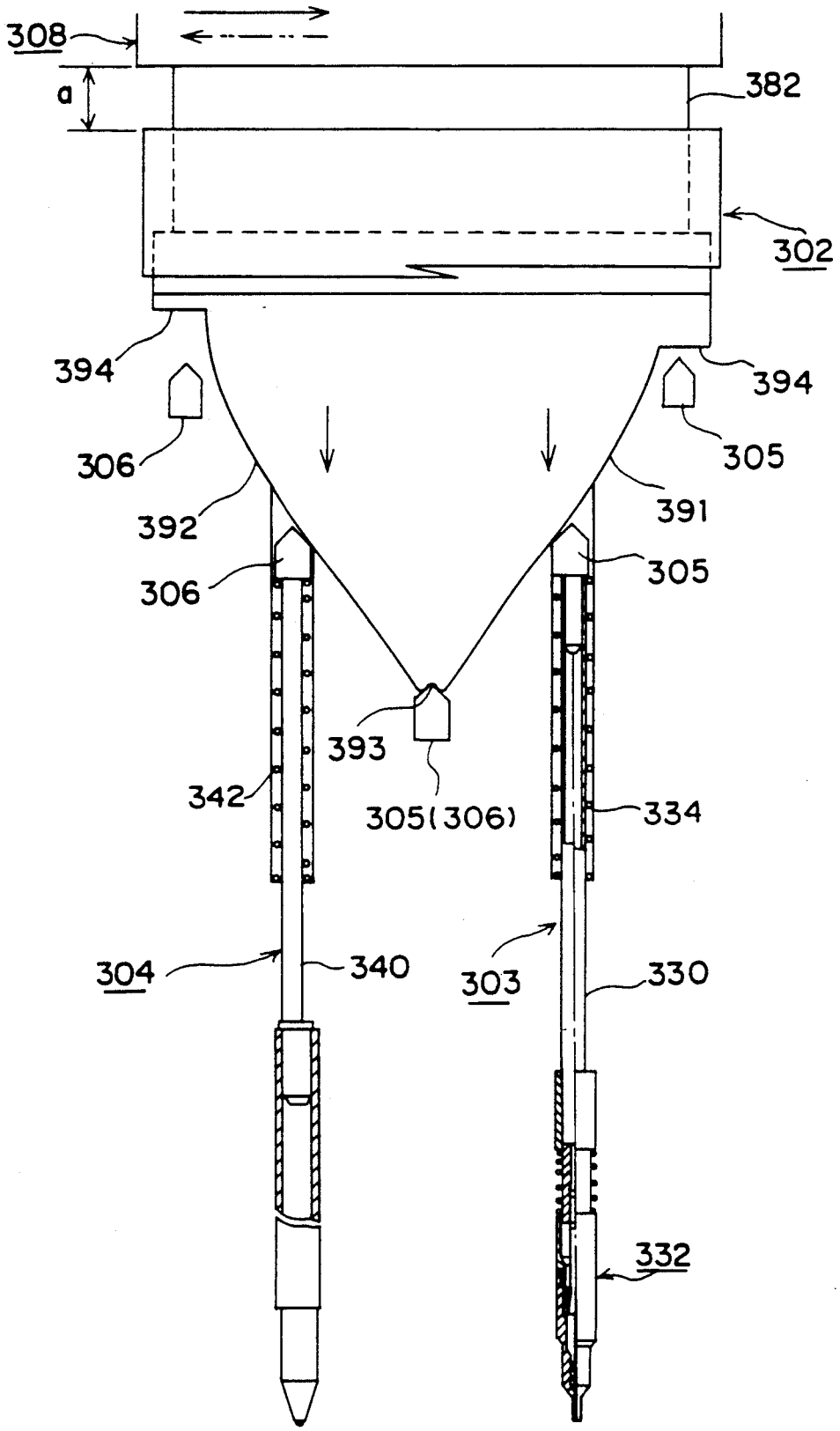
Figure 81:
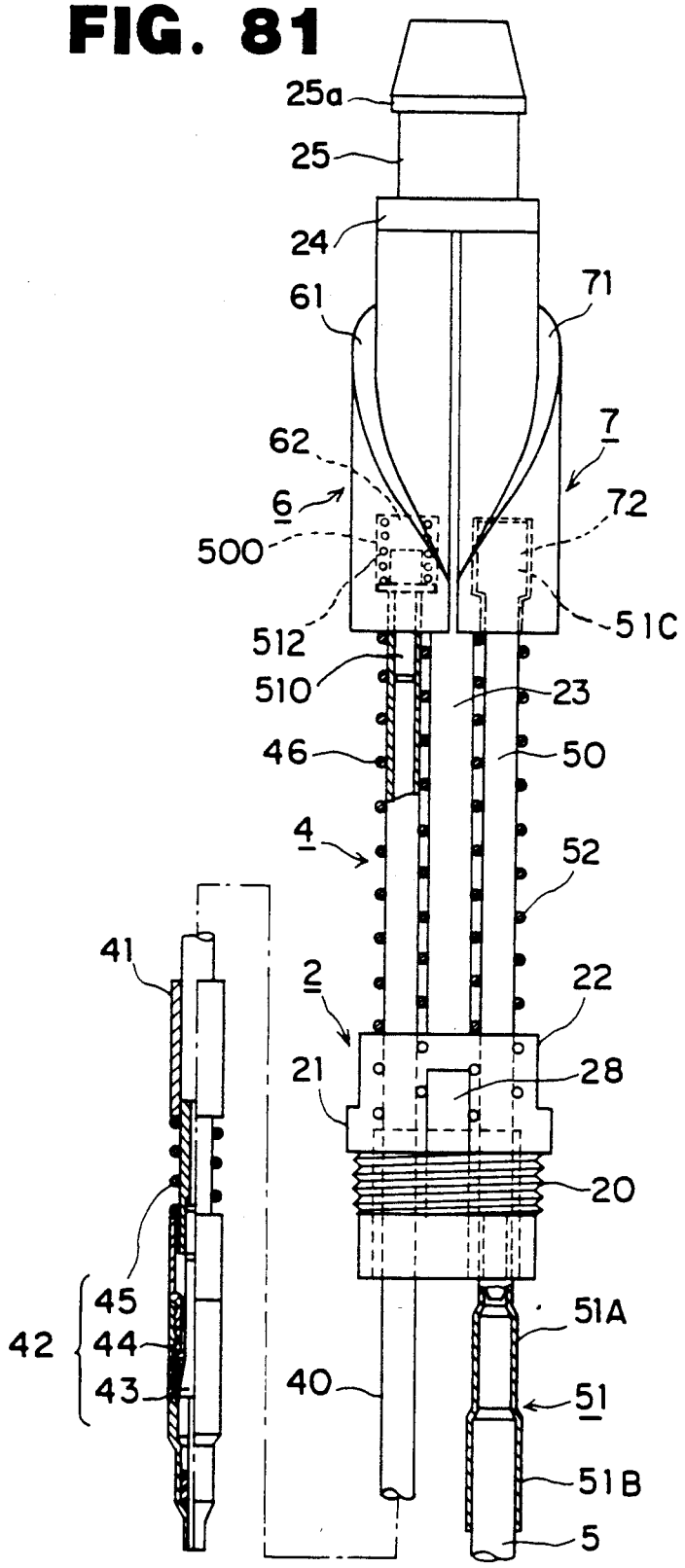
Figure 82:
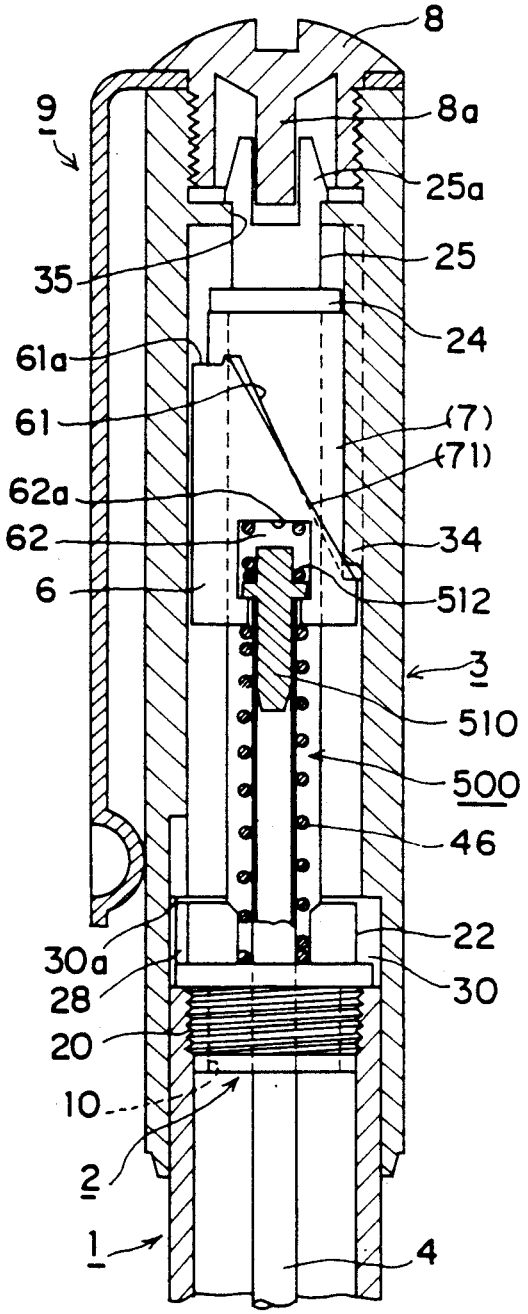
Figure 83:
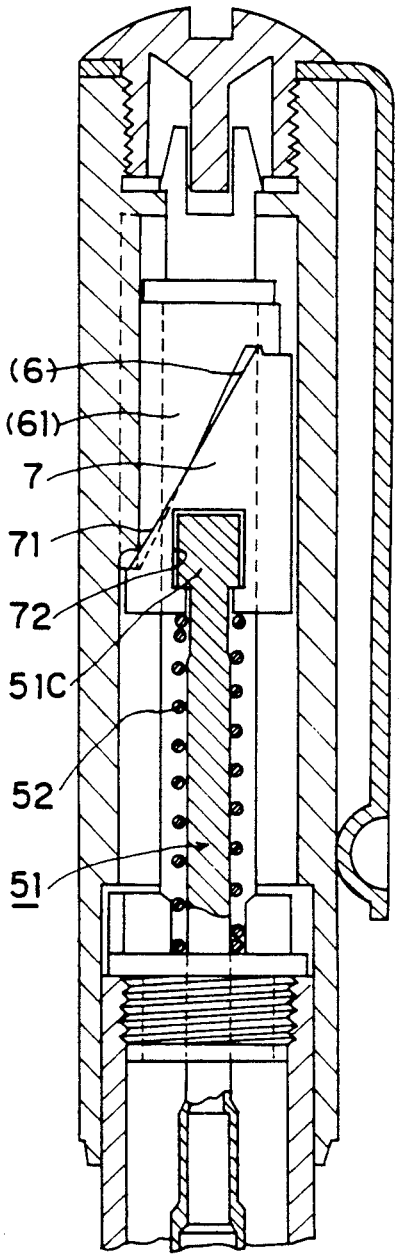

FIG. 38 is a partly sectional view showing a penholder;

FIG. 39 is a sectional view taken along the line III—III of FIG. 31;

FIG. 40(A) is a plan view showing a slider;

FIG. 40(B) is a front view of FIG. 40(A);

FIG. 41 is a plan view showing a cam cylinder;

FIG. 42 is a sectional view taken along the line IV—IV of FIG. 41;

FIG. 43 is a sectional view taken along the line V—V of FIG. 42;

FIG. 44 is a developed explanatory view illustrating functions of a cam cylinder;

FIG. 45 is a view, in the same section with that of FIG. 39, showing another example of the slider;

FIG. 46 is a plan view showing a sheath according to another example of a mechanism for restricting a transfer of a cam cylinder;

FIG. 47 is a sectional view of FIG. 46;

FIG. 48 is a sectional view taken along the line VI—VI of FIG. 46;

FIG. 49 is a plan view showing a cam cylinder which is applied to the sheath according to another example of the mechanism for restricting a transfer of a cam cylinder;

FIG. 50 is a sectional view taken along the line VII—VII of FIG. 49;

FIG. 51 is a sectional view taken along the line VIII—VIII of FIG. 50;

FIG. 52 is a developed explanatory view illustrating functions of the cam cylinder of FIG. 49;

FIG. 53 is a development showing the cam cylinder according to another example of a mechanism for restricting a transfer of the cam cylinder;

FIG. 54 is a sectional view of a writing utensil showing another example of the mechanism for restricting a transfer of the cam cylinder;

FIG. 55 is a sectional view showing the sheath of FIG. 54;

FIG. 56 is a rear end view illustrating a state in which a cam cylinder is fitted into the sheath of FIG. 54;

FIG. 57 is a sectional view taken along the line X—X of FIG. 55;

FIG. 58 is a sectional view showing the cam cylinder of FIG. 54;

FIG. 59 is a sectional view taken along the line XI—XI of FIG. 58;

FIG. 60 is a plan view of a cam cylinder showing another example of the mechanism for restricting a transfer of the cam cylinder;

FIG. 61 is a developed explanatory view illustrating functions of the cam cylinder of FIG. 60;

FIG. 62 is a longitudinal sectional view showing the writing utensil according to another example of the present invention;

FIG. 63 is a sectional view showing an essential part of the forward outer cylinder of FIG. 62;

FIG. 64 is a sectional view showing the sheath of FIG. 62;

FIG. 65 is a sectional view showing the writing utensil according to another embodiment of the present invention;

FIG. 66 is an enlarged front view showing an essential part of FIG. 65;

FIG. 67 is a perspective view showing a correlated construction of a junction outer cylinder and a cam cylinder;

FIG. 68 is a sectional view taken along the line VI—VI of FIG. 67;

FIG. 69 is a sectional side view taken along the line VII—VII of FIG. 67 wherein parts other than the outer cylinder and the junction outer cylinder are coaxially arranged;

FIG. 70 is a sectional view taken along the line VIII—VIII of FIG. 67;

FIG. 71 is a sectional view taken along the line V—V of FIG. 68;

FIG. 72 is a partly sectional view showing a pen-holder;

FIG. 73 is a plan view showing a cam cylinder;

FIG. 74 is a sectional view taken along the line X—X of FIG. 73;

FIG. 75 is a sectional view taken along the line XI—XI of FIG. 74;

FIG. 76 is a plan view of a clip 400 shown in FIG. 65;

FIG. 77 is a front view of FIG. 76;

FIG. 78 is a right side view of FIG. 76;

FIG. 79 is a partly sectional view showing the relation between a cap and a clip illustrated in FIG. 65;

FIG. 80 is a developed explanatory view illustrating functions of cam cylinder according to another example;

FIG. 81 is a plan view, partly in section, showing an inside unit construction of a writing utensil;

FIG. 82 is an enlarged sectional view of the rearward outer cylinder of FIG. 1 viewed from the side of the mechanical pencil holder; and FIG. 83 is an enlarged sectional view of the rearward outer cylinder of FIG. 81 viewed from the side of the ball point pen-holder.

DETAILED DESCRIPTION PREFERRED EMBODIMENTS OF THE INVENTION

The embodiments of the present invention will be described hereinafter by referring to the accompanying drawings.

In FIG. 1, reference number 1 designates a forward outer cylinder of a writing utensil to the rear end portion of which is connected a rearward outer cylinder 3 through a sheath 2 in a reversibly movable and insertable manner. It is to be noted that the rearward outer cylinder 3 is also slidable along the axial direction thereof by performance of a knocking operation.

The aforesaid sheath 2 is detachably connected to the rear end portion of said forward outer cylinder 1, the connecting means of which is formed such that the outside screwed cylindrical portion 20 defined at the extreme end of the sheath 2 is screwed to the inside screwed portion 10 defined at the rear end of the forward outer cylinder 1. A front end of a forward circular stepped portion 21 having an enlarged diameter is integrally connected to the rear end of said outside screwed cylindrical portion 20 and abuts against the rear end of said forward outer cylinder 1. In this case, said forward circular stepped portion 21 has the substantially same outer diameter as that of the forward outer cylinder 1.

More specifically, said sheath 2 includes a cylindrical portion 22 which is integrally connected coaxially with and has a diameter smaller than the rear end of the forward circular stepped portion 21 as shown in FIGS. 4–8. The circular portion 22 has substantially the same outer diameter as does said outer screwed cylindrical portion 20.

Moreover, a plate-like sheath shaft portion 23 is integrally connected to the rear end of said cylindrical portion 22 in a coaxial manner, a rearward circular stepped portion 24 having a larger diameter than that of the cylindrical portion 22 is integrally connected to the rear end of the sheath shaft portion 23 in a coaxial manner, and an engaging shaft portion 25 having a smaller diameter than that of the stepped portion 24 is integrally connected to the rear end of the rearward circular stepped portion 24 in a coaxial manner.

The engaging shaft portion 25 is bifunctional rearwardly such that its rear end is provided with a locking claw 25*a*.

Figure 6:
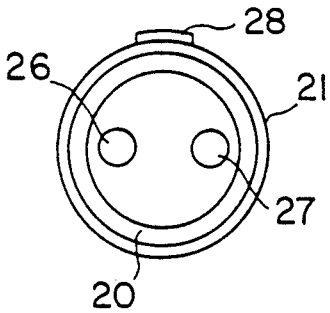
FIG. 6 is a bottom plan view of FIG. 4.
Figure 8:
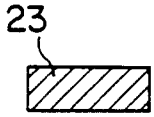
FIG. 8 is a sectional view taken along the line VIII—VIII of FIG. 5.
Figure 7:
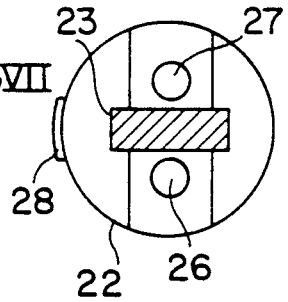
FIG. 7 is a sectional view taken along the line VII—VII of FIG. 5.

Two slide holes 26 and 27, communicating through the outside screwed cylindrical portion 20 and the cylindrical portion 22 at symmetrical positions on either side of the shaft center thereof, extend forwardly from said forward circular stepped portion 21, respectively, as shown in FIGS. 6 and 7.

Furthermore, a whirl-stop projection 28, which restricts the range of rotation of the rearward outer cylinder 3, is integral with and extends outwardly from the outer circumference of the forward circular stepped portion 21 of said sheath 2.

The whirl-stop projection 28 is contained in an enlarged diameter portion 30 formed on the inner circumferential surface of the forward end of said rearward outer cylinder 3.

Figure 9A:
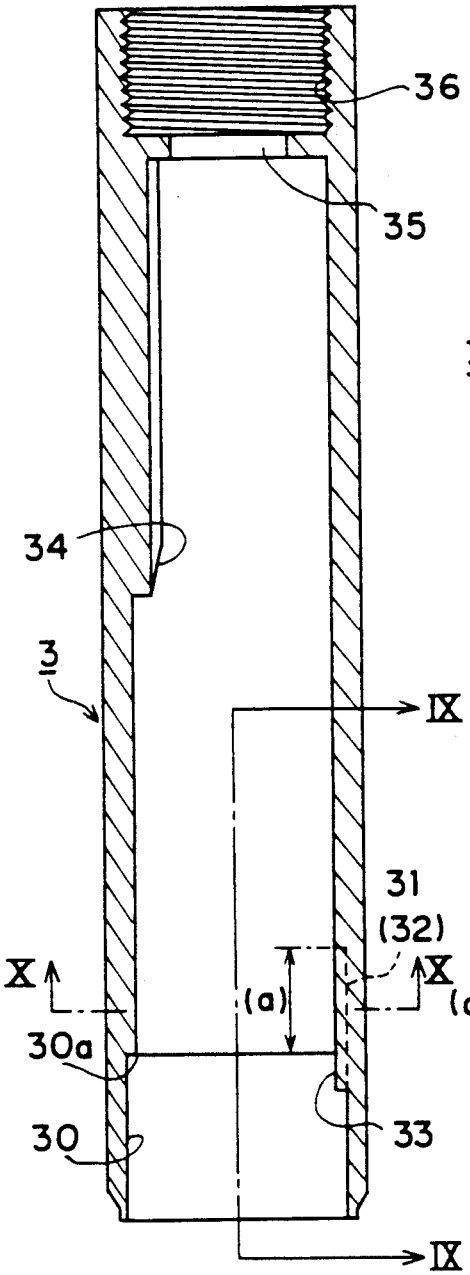
FIG. 9(A) is a sectional view showing a rearward outer cylinder.
Figure 10:
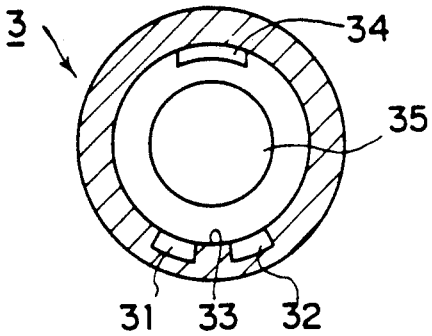
FIG. 10 is a sectional view taken along the line X—X of FIG. 9(A)
Figure 9B:
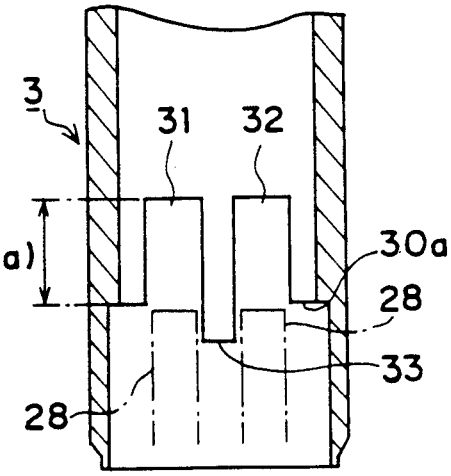
FIG. 9(B) is a sectional view taken along the line IX—IX of FIG. 9(A)

Defined on the forward inner circumferential surface of said rearward outer cylinder 3 are a pair of axial slide grooves 31 and 32 which are connected with the rear end of said enlarged diameter portion 30 and extend in parallel with each other as shown in FIGS. 9A, 9B and 10 and which permit a knocking operation of said rearward outer cylinder 3.

Moreover, the extreme end portion 33 of a partition wall formed between these axial slide grooves 31 and 32 provides a whirl-stop projection 33 extending forwardly from a rear end stepped portion 30*a* of said enlarged diameter portion 30.

The whirl-stop projection 33 abuts against one side of the whirl-stop projection 28 of the sheath 2 by means of a rotation of said rearward outer cylinder 3 in either direction to restrict the rotation of said rearward outer cylinder 3 in said direction, while said whirl-stop projection 33 abuts against the other side of said whirl-stop projection 28 by means of a rotation of said rearward outer cylinder 3 in the other direction to restrict the rotation of said rearward outer cylinder 3 in the other direction.

Under such rotation restricting condition for the rearward outer cylinder 3 as mentioned above, said whirl-stop projection 33 abuts upon said whirl-stop projection 28, so that the rear end of said whirl-stop projection 28 is positioned directly forwardly of the forward end opening portion of either of the axial slide grooves 31 and 32.

As a result, said whirl-stop projection 28 becomes aligned to enter into either of said axial slide groves 31 and 32 so that when the rearward outer cylinder 3 is advanced by a knocking operation, said whirl-stop projection 28 slides into either of said axial slide grooves 31 and 32, to thereby permit a knocking operation of said rearward outer cylinder 3.

Accordingly, the axial length of said axial slide grooves 31 and 32, i.e. the distance (a) defined between the rear end stepped portion 30*a* of said enlarged diameter portion 30 and the rear end surfaces of said axial slide grooves 31 and 32, corresponds to the knocking margin which defines the length of lead advanced from a mechanical pencil holder 4 during each knocking operation. Thus, the writing utensil is arranged so as to allow said rearward outer cylinder 3 to advance by the distance (a) to allow a knocking operation.

It is to be noted that in the case where the writing utensil includes a combination of a mechanical pencil holder 4 and a ball point pen-holder 5 as described above, only one of said axial slide grooves 31 and 32 may be provided for knocking the mechanical pencil holder 4.

When the whirl-stop projection 33 is spaced from the whirl-stop projection 28 in the shaft rotating direction by means of a rotation of said rearward outer cylinder 3, the mechanical pencil holder 4 and the ball point pen-holder 5 are placed in a retracted and contained state.

In this situation, the rear end stepped portion 30*a* of said enlarged diameter portion 30 abuts against and engages with the rear end of said whirl-stop projection 28, so that said rearward outer cylinder 3 cannot advance.

Thus, said whirl-stop projection 28 prevents the occurrence of play along the axial direction of the rearward outer cylinder 3.

A cam engaging projection 34 for engaging cam surfaces 61 and 71 of sliders 6 and 7 (see FIGS. 1, 3, 9(A) and (10), which will be described, hereinafter is integrally extended from the midpoint to the rear end of the rearward outer cylinder 3 along the inner circumferential surface thereof.

Figure 11B:
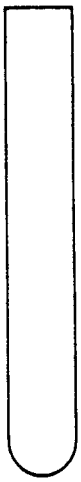

The cam engaging projection 34 is positioned diametrically opposite from said whirl-stop projection 33 on the inner circumferential surface of the rearward outer cylinder 3 as shown in FIG. 9(A) and FIG. 10. The aforesaid cam engaging projection 34 is formed at its extreme forward end with a profile which can move and engage smoothly with the respective cam surfaces 61 and 71 of said sliders 6 and 7. This forward end profile may be a sharply tapered one as shown in FIG. 11(A), a round one as shown in FIG. 11(B) or any other suitable shape.

Furthermore, defined inside said rearward outer cylinder 3 at the back thereof is a reduced diameter shaft insert hole 35, and an inside screwed hole portion 36 adjacent the rear end of said shaft insert hole 35.

The mechanical pencil holder as a first refill 4 and the ball point pen-holder as a second refill 5 are inserted into the slide holes 26 and 27 of said sheath 2, respectively, so as to be slidable along the axial direction thereof.

Regarding said mechanical pencil holder 4, a lead guide 41 is detachably connected to the forward end of a lead pipe 40 inserted into said slide hole 26 as shown in FIG. 12. Accordingly, if the lead pipe 40 is pulled out from the lead guide 41 after removing said sheath 2 from the forward outer cylinder 1, required leads can be supplied to said lead pipe 40.

In such mechanical pencil holder 4, a lead feeding mechanism 42 is disposed on the forward end side of the lead guide 41. The lead feeding mechanism 42 comprises a lead chuck 43, a chuck fastening ring 44, and a first elastic member 45 as a cushion means.

The ball point pen-holder 5 is detachably connected to the front end of a pen attaching shaft 50 which is inserted slidably in the slide hole 27 through a pen-holder 51.

The pen-holder 51 is composed of a small diameter meshing cylindrical portion 51A with which can be meshed and connected the lead pipe 40 of the mechanical pencil holder 4 and a larger diameter meshing cylindrical portion 51B wherein the rear end side of the ball point pen-holder 5 is detachably connected to the forward end of said small diameter meshing cylindrical portion in a communicating manner.

Accordingly, if the ball point pen-holder 5 is pulled out from the large diameter meshing cylindrical portion 51B and a separate mechanical pencil holder having a different lead diameter or type from that of said mechanical pencil holder 4 is fitted in and connected to said small diameter meshing cylindrical portion 51A, interchangeability of the refills is obtained.

The sliders 6 and 7 are integrally connected to the respective rear ends of such mechanical pencil holder 4 and ball point pen-holder 5.

Figure 2:
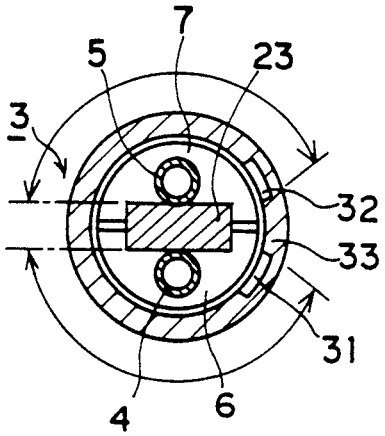
FIG. 2 is a sectional view taken along the line II—II of FIG. 1.
Figure 3:
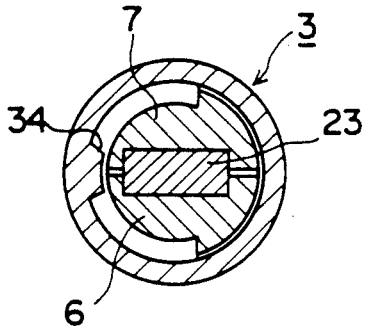
FIG. 3 is a sectional view taken along the line III—III of FIG. 1.
Figure 4:
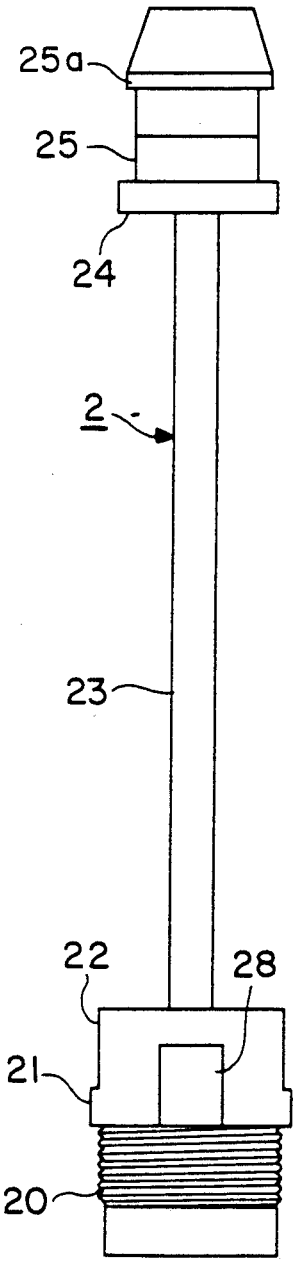
FIG. 4 is an enlarged plan view showing a sheath.
Figure 5:
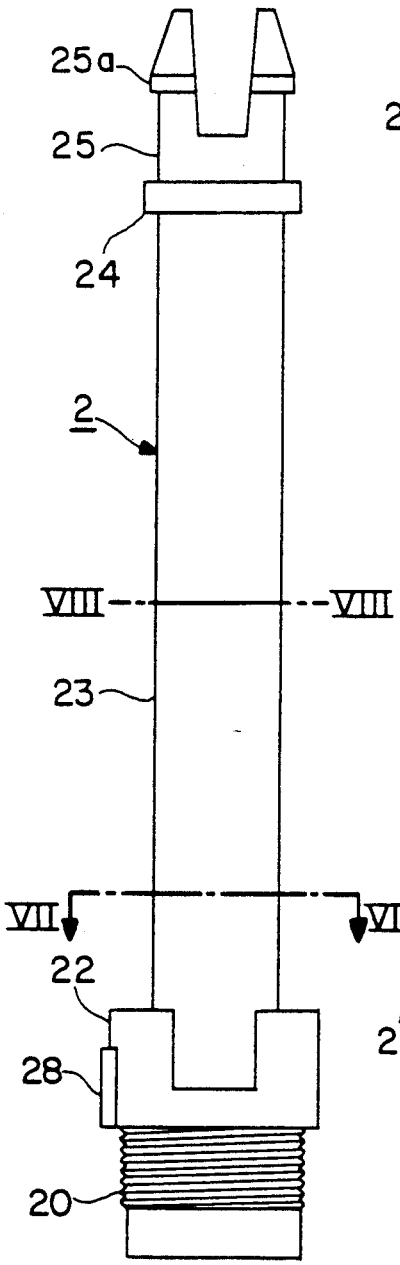
FIG. 5 is a side view of FIG. 4.

These sliders 6 and 7 are formed as individual semi-cylindrical members as shown in FIGS. 2, 3 and 14, and include axial slide grooves 60 and 70, respectively, defined on their flat inner surfaces. When the flat inner surfaces are mutually adjacently disposed, the slide grooves 60 and 70 abut the sheath 2 and the sliders together form a cylindrically-shaped member.

The sheath shaft portion 23 is inserted longitudinally into the axial slide grooves 60 and 70 to hold said sheath shaft portion 23. Thus, it is arranged such that said sliders 6 and 7 can be individually slid along the axial direction thereof along with said mechanical pencil holder 4 or ball point pen-holder 5, respectively.

And said mechanical pencil holder 4 and ball point pen-holder 5 are urged always towards the backward direction by means of elastic members 46 and 52 interposed between the rear end of the circular stepped portion 21 of the sheath 2 and the respective front ends of the sliders 6 and 7.

As a result, the respective rear ends of said sliders 6 and 7 abut against the front end of the rearward circular stepped portion 24 of the sheath shaft portion 23, so that backward movement of the sliders is restricted.

Under such united condition of the sheath 2, the mechanical pencil holder 4 and the ball point pen-holder 5 as well as the sliders 6 and 7 and the like, the outside screwed cylindrical portion 20 of the sheath 2 is threadedly engaged and connected with the inside screwed portion 10 of the forward outer cylinder 1, and then the forward end of the rearward outer cylinder 3 is rotatably fitted about the rear end side of said forward outer cylinder 1.

At the time of such fitting of said outer cylinder, the shaft insert hole 35 of the rearward outer cylinder 3 is forcibly introduced over the engaging shaft portion 25 of the sheath 2 such that said locking claw 25*a* passes through said shaft insert hole 35 and is engaged at its forward end with the rear end surface of said shaft insert hole 35.

In such situation, a top machine screw 8 is threadedly engaged with the inside screwed hole portion 36 on the rear end side of said rearward outer cylinder 3. When a thrust shaft portion 8*a* of said top machine screw 8 is inserted in said engaging shaft portion 25, the engagement of the locking claw 25*a* within said shaft insert hole 35 becomes more positive and firm.

Furthermore, a clip 9 is fastened at its rearward end to said top machine screw 8 so as to provide a clip attached to the rear end of the rearward outer cylinder 3.

Thus, the whole writing utensil has been assembled. Under such assembled condition, the sliders 6 and 7 are urged rearwardly by the elastic members 46 and 52, respectively. Mutual front end opposed surface portions of the cam surfaces 61 and 71 formed on the respective outer circumferential surfaces of said sliders 6 and 7 are thereby forcibly engaged with the cam engaging projection 34 which is integral with the rearward outer cylinder 3.

Thus, in the neutral retracted position the sliders 6 and 7 are retained at the same longitudinal position, as shown in FIG. 13, and the cam surfaces 61 and 71 are retained in a symmetrical position abut an axial plane.

Moreover, the respective rear end portions of said cam surfaces 61 and 71 are provided with rear end locking portions 61*a* and 71*a* as shown in FIGS. 1 and 13.

These rear end locking portions 61*a* and 71*a* are formed with a concave profile corresponding to the forward end shape of said cam engaging projection 34.

In the condition shown in FIGS. 1, 12 and 13 where both the forward ends of said cam surfaces 61 and 71 are engaged with said cam engaging projection 34, the respective sliders 6 and 7 are retracted so that both the mechanical pencil holder 4 and the ball point pen-holder 5 are maintained together at the retracted and contained position in the forward outer cylinder 1. On the other hand, when said cam engaging projection 34 is engaged with either of the rear end locking portions 61*a* and 71*a* of said cam surfaces 61 and 71 by the rotation of the rearward outer cylinder 3, the slider 6 or 7 on the engaged side is retained in an advanced state so that the corresponding mechanical pencil holder 4 or ball point pen-holder 5 is kept in a writing condition where it is projected from the forward outer cylinder 1.

As described above, the writing utensil of the present invention is constructed such that the mechanical pencil holder 4 and the ball point pen-holder 5 can be alternately moved forwards and backwards by means of a rotation of the rearward outer cylinder 3, or they may be contained together in the outer cylinder when the rearward outer cylinder is placed into a neutral position.

It is to be understood that since said sliders 6 and 7 perform a rotation restricting function for said rearward outer cylinder 3, the whirl-stop projection 33 on the rearward outer cylinder 3 may be omitted.

More specifically, when the locking claw 25*a* of the engaging shaft portion 25 of the sheath shaft portion 23 is inserted within the shaft insert hole 35, rotation of the rearward outer cylinder 3 causes the cam engaging projection 34 to slide on either of the cam surfaces 61 and 71 in the direction from the forward end thereof to either of the rear end locking portions 61*a* and 71*a*. This causes the corresponding one of the sliders 6 and 7 to advance forwardly so that the sliders 6 and 7 are axially offset from one another. Thus, when said cam engaging projection 34 is engaged with said side end surface, rotation of the rearward outer cylinder 3 is restricted.

In accordance with the arrangement described above, said rearward outer cylinder 3 can be rotated by about 180 degrees.

Next, the operation of the above described embodiment of the writing utensil will be described.

When the rearward outer cylinder 3 is rotated in either direction from its neutral position, the cam engaging projection 34 being integral therewith slides on, for example, the cam surface 61 of the slider 6 from the forward end thereof toward the rear end locking portion 61*a*, such that said slider 6 advances against the elastic member 46. As a result, the mechanical pencil holder 4 being integral with the slider 6 is advanced and projected from the forward outer cylinder 1. When said cam engaging projection 34 is engaged with the rear end locking portion 61*a* of said cam surface 61, the mechanical pencil holder 4 is maintained in a writing condition.

In this writing condition, when the rearward outer cylinder 3 is knocked, said cam engaging projection 34 presses the rear end locking portion 61*a* of said cam surface 61 further forwardly and thus the slider 6 is moved further forward so that a lead of the mechanical pencil holder 4 is fed out.

When said rearward outer cylinder 3 is reversely rotated from the aforesaid writing condition, the engagement of said cam engaging projection 34 with the rear end locking portion 61*a* is released so that the cam engaging projection 34 slides along said cam surface 61, and said slider 6 is moved backwards by means of an urging force of the elastic member 46. Because of this backward movement of the slider, the mechanical pencil holder 4 is retracted and contained in the outer cylinder, and the forward end of said cam engaging projection 34 is engaged with the forward ends of the cam surfaces 61 and 71.

When said rearward outer cylinder 3 is rotated in the other direction from the state mentioned above, said cam engaging projection 34 slides urgingly on the cam surface 71 of the slider 7 towards the rear end locking portion 71*a*, whereby the aforesaid other slider 7 moves forwardly to project the ball point pen-holder 5, which is integral with said slider 7, to a writing position. As a result, the cam engaging projection 34 is engaged with the rear end locking portion 71*a* of said cam surface 71, whereby the ball point pen-holder 5 is maintained at a locked state in a writing position.

In the state described above, when the rearward outer cylinder 3 is reversely rotated, the slider 7 for the ball point pen-holder 5 system moves backwards, in the same manner as in the case of said mechanical pencil holder 4 system, so that the ball point pen-holder 5 is contained in the outer cylinder.

In the condition where the mechanical pencil holder 4 has been projected and the ball point pen-holder 5 has been retracted by means of a rotation of said rearward outer cylinder 3 in either direction, the cam engaging projection 34 is engaged with one side surface of the whirl-stop projection 28, whereby further rotation of said rearward outer cylinder 3 is in the aforesaid direction is restricted. Similarly, said cam engaging projection 34 is engaged with the other side surface of said whirl-stop projection 28 when the mechanical pencil holder 4 has been retracted and the ball point pen-holder 5 has been projected by a rotation of said rearward outer cylinder 3 in the other direction, and further rotation of the rearward outer cylinder 3 in the other direction is restricted.

Another embodiment of the present invention will be described hereinbelow.

Referring to FIG. 15, reference numeral 101 designates an outer cylinder of a writing utensil, and a junction outer cylinder 102 is detachably connected to the rear end portion of the outer cylinder 101.

A means for the connection described above is provided by a reduced outer diameter portion 120 formed on the forward end of said junction outer cylinder 102 which is detachably forced into and connected to a rear end cylindrical portion 110 having an enlarged inner diameter formed on the rear end side of said outer cylinder 101 as shown in FIGS. 15–18.

In this case, the engagement is effected by fitting whirl-stop projections 111 provided on the inner circumferential surface of said rear end cylindrical portion 110 into axial engaging grooves 121 defined on the outer circumferential surface of said forward end circular portion 120 at diametrically opposite positions thereof as shown in FIGS. 19 and 21. Thus, said junction outer cylinder 102 is engaged with said outer cylinder 101 in the shaft rotating direction thereof so that they rotate simultaneously.

Furthermore, said forward end circular portion 120 includes a shaft insert hole 122 defined at the shaft center portion thereof and two slide holes 123 and 124 for inserting refills (FIGS. 20 and 21) at such positions sandwiching said shaft insert hole 122 and being displaced by 90 degrees from said axial engaging groove 121, respectively, as shown in FIG. 17 through FIG. 21.

Into these slide holes 123 and 124, a mechanical pencil holder 103 as a first refill and a ball point pen-holder 104 as a second refill are slidably inserted along the axial direction thereof as shown in FIG. 15.

As shown in FIGS. 20 and 21, said slide holes 123 and 124 are formed in such a manner that said mechanical pencil holder 103 and said ball point pen-holder 104 may be smoothly slid while bending (flexing) during advancement and projection, by making the holes 123, 124 of a longer diameter in the bending direction and defining an elliptical profile which becomes of a gradually larger diameter towards the rear end thereof.

As shown in FIGS. 15 and 20, reference numerals 123*a* and 124*a* designate annular projections extending from the inner circumferential wall on the forward end of said slide holes 123 and 124, which lock the front ends of elastic members 134 and 142 and prevent the mechanical pencil holder 103 and the ball point pen-holder 104 from slipping out of the slide holes 123 and 124.

With respect to said mechanical pencil holder 103, a lead guide 131 is detachably connected to the forward end of a lead pipe 130 inserted in either of the slide holes 123, 124 as shown in FIG. 15. According to the construction described above, after pulling the junction outer cylinder 102 off from the outer cylinder 101, when said lead pipe 130 is pulled off from a lead guide 131, leads can be supplied to said lead pipe 130.

In such mechanical pencil holder 103, a lead feeding mechanism 132 is disposed forwardly of the lead guide 131. Furthermore, the lead feeding mechanism 132 has a construction comprising a lead chuck and a chuck fastening ring (not shown) as well as a first elastic member 133.

On one hand, the ball point pen-holder 104 is detachably connected to the front end of the pen attaching shaft 140 inserted slidably into the other slide hole 124. In this case, said ball point pen-holder 104 may be connected to the front end of the pen attaching shaft 140 through a pen-holder 141 as shown in FIG. 24.

In the case described above, the pen-holder 141 comprises a connecting cylindrical portion 141A of a small diameter with which is meshed and connected a forward end small diameter shaft portion 140*a* of the pen attaching shaft 140 by means of press fitting, adhesive bonding or the like, a somewhat larger diameter meshing cylindrical portion 141B which is integrally connected with the forward end of said connecting cylindrical portion 141A and which is capable of connection with the lead pipe 130 of said mechanical pencil holder 103, and a larger diameter meshing cylindrical portion 141C which is connected to the forward end of the cylindrical portion 141B and which is detachably connected with the mechanical pencil holder 104 on the rear end side.

In such pen-holder 141, refills can be interchanged when the ball point pen-holder 104, meshed and connected with the large diameter meshing cylindrical portion 141C, is pulled out and another mechanical pencil holder, which differs from said mechanical pencil holder 103 in a diameter of lead used or a type thereof, is meshed and connected with said small diameter meshing cylindrical portion 141B.

To the respective rear ends of said mechanical pencil holder 103 and ball point pen-holder 104 are integrally connected cam engaging members (sliders) 105 and 106 which are forcibly engaged with a front end cam surface of a cam cylinder 109 which is shown in FIG. 15 and will be described hereinbelow.

As shown in FIGS. 19, 20 and 23, these cam engaging members 105 and 106 are fitted into axial guide grooves 125 and 126 defined on the inner circumferential surface of said junction outer cylinder 102, such that said members 105 and 106 are smoothly slid along the axial direction thereof.

Said mechanical pencil holder 103 and said ball point pen-holder 104 are urged towards the retracting direction by the elastic members 134 and 142 interposed between rear end open wall surfaces 123*a* and 124*a* of said slide holes 123, 124 and said cam engaging members 105, 106, respectively.

Furthermore, a semicylindrical portion 128 is formed on the rear end side of said junction outer cylinder 102 as shown in FIGS. 18 and 19.

A side surface of said semicylindrical portion 128 forms a stopper surface 128*a*, on a ball point pen feeding side, which restricts a rotation of a cam cylinder 109, which will be described hereunder, in either direction, while the other side surface of said semicylindrical portion 128 forms a stopper surface 128*b*, on a mechanical pencil feeding side, which restricts a rotation of said cam cylinder 109 in the other direction.

An axial locking stepped portion 128*c* for restricting forward movement of said cam cylinder 109 is disposed on the stopper surface 128*b* on the mechanical pencil feeding side.

In this construction, a distance (a) is defined between the rear end surface 102*a* of the junction outer cylinder 102 on the front end of said semicylindrical portion 128 and the axial locking stepped portion 128*c* as shown in FIGS. 15–17. The distance (a) corresponds to a knocking margin for feeding a lead in said mechanical pencil holder 103.

A through cylindrical cap 107 provided with a clip 170 is outwardly mounted on the rear end portion of the junction outer cylinder 102 as described above, in a rotatable manner as well as an axially slidable manner.

A sheath 108 is inserted and contained in the cap 107 by means of press fitting, meshing and the like manner so that the shaft rotating direction thereof is locked, and the cam cylinder 109 formed integrally on the front end of said sheath 108 is inserted into said junction outer cylinder 102 in a rotatable manner as well as an axially slidable manner.

As shown in FIGS. 15–17 as well as FIGS. 25 and 27, said sheath 108 is provided with an eraser containing cylindrical portion 180 and a larger diameter circular stepped portion 181 formed integrally on the outer circumferential surface on the front end side thereof. The circular stepped portion 181 is engaged with the inside of said cap 107.

Such engagement is provided by a convex portion 107*a* extending integrally from the inner circumferential surface of said cap 107 on the rear end side which is slidably fitted into and engaged with a concave portion 181*a* defined on the outer circumferential surface of said circular stepped portion 181 in the axial direction thereof.

As a result, sheath 108 is engaged with said cap 107 upon rotation so that said cap 107 can be simultaneously rotated with said sheath 108, and remain slidable in the axial direction. An alternative connection is provided when the concave portion 181*a* is defined on the cap 107, whilst the convex portion 107*a* is defined on the circular stepped portion 181, respectively, such that they are pressingly fitted in and engaged with each other. Moreover, a one-piece molding of the cap 107, the sheath 108, and the cam cylinder 109 is also possible, though such modification is not illustrated in the accompanying drawings, such that the number of parts can be reduced and steps for the assembly can be simplified.

An intermediate shaft portion 182 of a smaller diameter is integrally constructed on the front end of said circular stepped portion 181, and the cam cylinder 109 of a larger diameter is coaxially and integrally associated on the extreme end of said intermediate shaft portion 182.

Hence, this cam cylinder 109 is rotatable simultaneously with said sheath 108 and is slidable in the axial direction thereof.

And respective engaging members 105 and 106 of said mechanical pencil holder 103 and said ball point pen-holder 104 are pressed against and engaged with the cam surface of said cam cylinder 109 by means of an urging force of said elastic members 134 and 142.

Furthermore, a sheath shaft 183 extending forwardly through a shaft center portion inside said cam cylinder 109 is integrally constructed on the forward end of said intermediate shaft portion 182.

This sheath shaft 183 is inserted into said junction outer cylinder 102 from the rear end side thereof, and inserted slidably into a shaft insert hole 122 of said junction outer cylinder 102 on the forward end side along the axial direction thereof. Hence, the cam cylinder 109 being integral with said sheath 108 is contained in said junction outer cylinder 102 in a rotatable and axially slidable manner.

In this case, the forward end of said sheath shaft 183 is screwed by a machine screw 185 as shown in FIGS. 15–17, so that the sheath shaft 183 and the cam cylinder 109 will not slip out from the inside of the junction outer cylinder 102. In this case, a press fitting member having an anchor shape may be used in place of said machine screw 185 and pressingly fitted to and meshed with the forward end of the sheath shaft 183.

An axial engaging projection 184 is integrally extended from the outer circumferential surface of said intermediate shaft portion 182 as shown in FIG. 17.

This axial engaging projection 184 functions to restrict rotation of as well as axial transfer of the cam cylinder 109. When the axial engaging projection 184 is engaged with the stopper surfaces 128*a* and 128*b* on the ball point pen feeding side during rotation in either direction, the ball point pen-holder 104 projects from the extreme end of the outer cylinder 101, and a rotation in either direction of said cam cylinder 109 is restricted such that the mechanical pencil holder 103 is retracted and contained in the outer cylinder 101. At the same time, when the extreme end of said axial engaging projection 184 is engaged with an axial locking stepped portion 128*c*, a forward movement of said cam cylinder 109 is restricted. Moreover, said axial engaging projection 184 is engaged with the stopper surface 128*b* on the mechanical pencil feeding side during rotation of the cam cylinder 109 in the other direction, so that the ball point pen-holder 104 is retracted in the outer cylinder 101 to restrict said rotation of the cam cylinder 109 in the other direction such that the mechanical pencil holder 103 projects from the extreme end of the outer cylinder 101. In this situation, said axial engaging projection 184 becomes forwardly transferable by said distance (a) along the stopper surface 128*b* on the mechanical pencil feeding side so that an advance of said cam cylinder 109 by a knocking operation is allowed.

As shown in FIGS. 15–17 and in addition, FIGS. 25, 26 and 27, said cam cylinder 109 is provided with curved and inclined cam surfaces 191 and 192 on the opposite sides of the forward end portion thereof, a forward end locking portion 193 disposed on the outermost end of these curved and inclined cam surfaces 191 and 192, and a rear end locking portion 194 on said curved and inclined cam surfaces 191 and 192.

The cam engaging member 105 of the mechanical pencil holder 103 and the cam engaging member 106 of the ball point pen-holder 104 are forced against and engaged with the curved and inclined cam surface 191 and the other curved and inclined cam surface 192 by means of the urging force of said elastic members 134 and 142, respectively.

Accordingly, when the cam engaging members 105 and 106 are kept at an intermediate position defined between the curved and inclined cam surfaces 191 and 192, by means of a rotation of the cam cylinder 109 as shown in FIG. 18, the mechanical pencil holder 103 and the ball point pen-holder 104 are contained and maintained in the forward outer cylinder 101 at their retracted positions.

Furthermore, when the cam engaging member 105 of the mechanical pencil holder 103 is engaged with the forward end locking portion 193, the mechanical pencil holder 103 projects forwardly, and at the same time, the cam engaging member 106 of the ball point pen-holder 104 is engaged with the rear end locking portion 194, whereby the ball point pen-holder 104 is maintained at the retracted and contained position. Similarly, when the cam engaging member 105 on the side of the mechanical pencil holder 103 and the cam engaging member 106 on the side of the ball point pen-holder 104 are engaged with the rear end locking portion 194 and the forward end locking portion 193, respectively, the mechanical pencil holder 103 and the ball point pen-holder 104 are maintained at the contained position and the projected position, respectively.

Thus, the mechanical pencil holder 103 and the ball point pen-holder 104 are alternately projected and retracted by a rotation of the cam cylinder 109.

In FIGS. 15 and 16, reference numeral 186 designates an eraser contained in an eraser containing cylindrical portion 180, and reference numeral 187 designates a knocking cap fitted detachably to the eraser containing cylindrical portion 180 and covering said eraser 186.

Next, operations of a writing utensil according to the aforesaid embodiment will be described.

When the cap 107 is rotated in either direction, the cam cylinder 109 is simultaneously rotated in that direction through the sheath 108, so that the cam engaging member 105 of the mechanical pencil holder 104 moves forwardly on the curved and inclined cam surface 191 towards the side of the forward end locking portion 193 as shown in FIG. 18. At the same time, the cam engaging member 106 of the ball point pen-holder 104 transfers towards the rear end locking portion 194 on the other curved and inclined cam surface 192, whereby the ball point pen-holder 104 moves rearwards. This rearward movement is effected by means of an urging force of the elastic member 152.

At the same time of an engagement of the cam engaging member 105 on the side of the mechanical pencil holder 103 with said forward end locking portion 193 as well as an engagement of the cam engaging members 105 and 106 on the side of the ball point pen-holder 104 with said rear end locking portion 194, the axial engaging projection 194 is engaged with the stopper surface 128*b* on the mechanical pencil feeding side.

As a consequence, a rotation of said cam cylinder 109 in either direction is restricted, and said mechanical pencil holder 103 is maintained at such a position where it projects from the forward end of the outer cylinder 101, whilst the ball point pen-holder 104 is contained and maintained in the outer cylinder 101 at its retracted position.

In this condition, when the cap 107 or the knocking cap 187 at the rear end of said cap 107 is knocked, said cam cylinder 109 is forwardly transferred through said sheath 108 by a distance (a).

The cam engaging member 105 of the mechanical pencil holder 103 is advanced by means of the cam cylinder 109 in the above case, so that the lead pipe 130 is pushed forwardly to operate the lead feeding mechanism 132 to thereby advance a lead.

When the cap 107 is rotated from this position in the other direction, the cam cylinder 109 rotates simultaneously therewith in the other direction through the sheath 108, so that the cam engaging member 105 on the side of the mechanical pencil holder 103 moves rearwardly, by means of an urging force of the elastic member 134, along the curved and inclined cam surface 191 of said cam cylinder 109. At the same time, the cam engaging member 106 on the side of the ball point pen-holder 104 is pressingly forwarded by means of the other curved and inclined cam surface 192 of said cam cylinder 109.

As a result, the ball point pen-holder 104 moves forwardly to be projected, and at that position the cam engaging member 106 is engaged with the forward end locking portion 193 while said axial engaging projection 184 is engaged with the stopper surface 128*a* on the ball point pen feeding side in the junction outer cylinder 102, such that a rotation of said cam cylinder 109 in the other direction is restricted. Said axial engaging projection 184 is engaged also with the axial locking stepped portion 128*c* so that a forward movement of said cam cylinder 109 is restricted. And said ball point pen-holder 104 is maintained at a writing position where it is projected from the outer cylinder 101, and the mechanical pencil holder 103 is simultaneously retracted to a contained position.

FIG. 29 illustrates another embodiment of the writing utensil according to the present invention, wherein the junction outer cylinder 102 in the aforesaid embodiment is removed and the outer cylinder 101 is formed longer. The cam cylinder 109, which is integral with the sheath 108, is attached to said outer cylinder 101 as was the case of the aforesaid embodiment. Otherwise the construction and functioning of this embodiment correspond to the aforesaid embodiment. Accordingly, like parts of the present embodiment are shown by reference numerals corresponding to those of the aforesaid embodiment.

FIG. 30 illustrates another embodiment of the writing utensil according to the present invention wherein the cap 107 is integrally constructed with the cam cylinder 109.

More specifically, the rear end portion of the cam cylinder 109 is connected with the inside of the rear end of the cap 107 by means of a one-piece molding. In this case, a one-piece molding of the cap 107 together with said cam cylinder 109 and said sheath shaft 183 is, of course, possible. Said sheath 108 may also be separately formed from the cam cylinder 109, such that the rear end side of said sheath 108 is inserted into a shaft insert hole 109*a* defined on a rear end wall portion of said cam cylinder 109 from the forward end thereof, and a locking claw 183*a* formed on the rear end of said sheath shaft 183 is allowed to engage with a rear end wall surface of said shaft insert hole 109*a*, whereby said cam cylinder 109 is connected with said sheath shaft 183. Thus, a one-piece molding of the cap 107 and the cam cylinder 109 as well as a molding for the sheath shaft 183 can very simply be carried out.

Still another embodiment of the present invention will be described hereinbelow.

Referring to FIGS. 31 and 32, reference numeral 201 designates a forward outer cylinder of a writing utensil, and to the rear end portion of the forward outer cylinder 201 is connected a rearward outer cylinder 203 through a sheath 202 in a reversibly rotatable and insertable manner. Furthermore, the rearward outer cylinder 203 is also slidable in the axial direction thereof so as to allow a knocking operation.

The aforesaid sheath 202 is detachably connected with a rear end portion of the forward outer cylinder 201, and as a connecting means therefor, an outside screwed cylindrical portion 220 on the forward end of the sheath 202 is threadedly engaged with an inside screwed portion 210 on the rear end of the forward outer cylinder 201. The front end of an enlarged diameter forward circular stepped portion 221 integrally associated on the same axis of the rear end of said outside screwed cylindrical portion 220, abuts against the rear end of said forward outer cylinder 201. Moreover, although the forward end of the sheath 202 has been threadedly engaged with and secured to the rear end of said forward outer cylinder 201 in the present embodiment, such engagement may alternatively be by means of a press fitting or the like.

It is to be noted that the outer diameter of said forward circular stepped portion 221 is smaller than that of the forward outer cylinder 201.

Namely, said sheath 202 is provided with a sheath shaft portion 222 connected integrally to the rear end of the forward circular stepped portion 221 in a coaxial manner as shown in FIGS. 33 and 34.

The sheath shaft portion 222 is formed into a flat plate of a rectangular profile having a thinner thickness S shown in FIG. 34 than a breadth H shown in FIG. 33.

For this reason, a length of the rearward outer cylinder 203 in the axial direction as well as a diametrical dimension can be shortened so that the whole writing utensil can be made compact.

Furthermore, a rearward enlarged diameter circular stepped portion 223 at the rear end of said sheath shaft portion 222 and a smaller diameter engaging shaft portion 224 at the rear end of said rearward circular stepped portion 223 are coaxially and integrally connected with each other.

The engaging shaft portion 224 is bifurcated rearwardly such that the rear end is provided with a locking claw 224*a*.

Two slide holes 225 and 226 are defined on the forward circular stepped portion for inserting refills therein into which communicate with the outside screwed cylindrical portion 220 at symmetrical positions with respect to the shaft center thereof such that a wall thickness of said flat plate-like sheath shaft portion 222 is sandwiched therebetween, as shown in FIGS. 31 and 34.

Moreover, a knocking stopper mechanism for restricting a forward movement of the rearward outer cylinder 203 and a locking projection 227 for restricting a rotation of the rearward outer cylinder 203 are integrally extended from the outer circumferential surface on the rear end side of the forward circular stepped portion 221 of said sheath 202 as shown in FIGS. 31, 33 and 35–37.

As a means for restricting a forward movement and a rotation of the rearward outer cylinder 203, a circumferential slide groove 230 for engaging with the locking projection 227 is defined on the inner circumferential surface on the front end side of the rearward outer cylinder 203 as shown in FIGS. 35 and 36.

The aforesaid circumferential slide groove 230 is substantially semicircumferential such that said locking projection 227 can be reversibly rotated by 180 degrees. In this embodiment, an axial slide groove 230*a* is connected to an end of the circumferential slide groove 230.

The axial slide groove 230*a* is a groove which allows for a knocking operation of a mechanical pencil holder 204 which will be described hereunder and is shown in FIGS. 31 and 36. A distance equal to a knocking margin (b) in the rear end of the sheath 202 or another knocking margin (a) which is longer than that of the former margin (b) is kept between the rear end of the axial slide groove 230*a* and the rear end of the locking projection 227.

Thus, when the axial slide groove 230*a* abuts against the rear end of said locking projection 227 at an advanced position of the rearward outer cylinder 203 during a knocking operation, a forward movement of said rearward outer cylinder 203 is restricted.

It is to be understood that the axial slide groove 230*a* is defined only on one end of the circumferential slide groove 230 in the present embodiment. This is because there is no need for performing a knocking for the ball point pen-holder 205.

However, it is necessary that both first and second refills be capable of a knocking operation in the case where both the refills are mechanical pencil holders. Thus, axial slide grooves 230*a* and 230*b* may be connected with and formed on opposite ends of the circumferential slide groove 230 as shown in FIG. 37.

The mechanical pencil holder (first refill) 204 and the ball point pen-holder (second refill) 205 are slidably inserted in the slide holes 225 and 226 of said sheath 202, respectively, along the axial direction as shown in FIG. 31.

With respect to said mechanical pencil holder 204, since a lead guide 241 is detachably connected to the forward end of a lead pipe 240 inserted into said slide hole 225, a lead can be supplied to said lead pipe 240 by pulling the rearward outer cylinder 203 out from the forward outer cylinder 203 to remove said sheath 202 from the forward outer cylinder 201, and then drawing out the lead pipe 240 from the lead guide 241.

In this mechanical pencil holder 204, a lead feeding mechanism 242 is disposed on the forward end side of the lead guide 241. Furthermore, the lead feeding mechanism 242 includes a lead chuck and a chuck fastening ring (not shown), as well as a first elastic member 243.

The ball point pen-holder 205 is detachably connected to the front end of a pen attaching shaft 250 inserted slidably into the slide hole 226. It is to be noted that said ball point pen-holder 205 may be connected to the front end of the pen attaching shaft 250 through a pen-holder 251 as shown in FIG. 38. In this case, the pen-holder 251 comprises a small diameter connecting cylindrical portion 251A into which is fitted and connected a forward end small diameter shaft portion 250*a* of the pen attaching shaft 250 by means of press fitting, adhesive bonding or the like, a somewhat larger diameter meshing cylindrical portion 251B which is connected integrally with the forward end of said connecting cylindrical portion and to which can be fitted and connected the lead pipe 240 of said mechanical pencil holder 204, and a larger diameter meshing cylindrical portion 251C which is communicated with the forward end of said meshing cylindrical portion 251B and with which is detachably connected the ball point pen-holder 205 on the rear end side.

Refills can be interchanged when the ball point pen-holder 205 meshed and connected with the large diameter meshing cylindrical portion 251C is pulled out and another mechanical pencil holder, which differs from said mechanical pencil holder 204 in a diameter of lead or a type thereof, is meshed and connected with said meshing cylindrical portion 251B.

To the respective rear ends of said mechanical pencil holder 204 and ball point pen-holder 205 are integrally connected sliders 206 and 207.

As shown in FIG. 39, the sliders 206 and 207 are made of symmetrical semi-circular members, and axial slide grooves 260 and 270 are defined on flat surfaces on the respective sides of circular arc centers. These axial slide grooves 260 and 270 are defined with a groove width corresponding to a breadth H of said sheath shaft portion 222, and it is sandwiched between these grooves in the up and down directions so that these slide grooves can be slide separately in the axial direction while holding the sheath shaft portion 222 therebetween.

Thus, opposite wall portions of the aforesaid respective axial slide grooves 260 and 270 are formed into hooking leg portions 260*a*, 260*a* and 270*a*, 270*a*, respectively, which are slidable with respect to the opposite side surfaces of said sheath shaft portions 222 in the axial direction and engaged in its shaft rotating direction.

In reference to these sliders 206 and 207, since the bottom surfaces of said axial slide grooves contact in plane with up and down flat surfaces of the sheath shaft portion 222 and said hooking leg portions 260*a*, 260*a* and 270*a*, 270*a* engage with a side surface of said sheath shaft portions 222 with respect to a load in its shaft rotating direction, said sliders 206 and 207 can smoothly and stably slide without slipping out from said sheath shaft portion 222.

From the central portion of the respective outer circumferential surfaces of said sliders 206 and 207, cam engaging projections 261 and 271 are integrally extended (see FIGS. 31, 32, 39 and 40). The rear ends of projections 261 and 271 pressingly contact and engage with a cam surface of a cam cylinder 208 which will be described hereinbelow and which are members for forcibly advancing the sliders 26 and 207.

The rear end portions of the respective cam engaging projections 261 and 271 are formed with a sharply tapered profile, as shown in FIGS. 32 and 40, or a circular or the like profile (not shown).

Said mechanical pencil holder 204 and said ball point pen-holder 205 are urged always toward a retracted position by means of elastic members 244 and 252 interposed between the rear end of the forward circular stepped portion 221 of said sheath 202 and the respective front ends of the sliders 206 and 207.

As a result, the rear ends of the cam engaging projections 261 and 271 of the respective sliders 206 and 207 press against a cam surface of the cam cylinder 208.

As described above, the cam cylinder 208 for alternating projecting and retracting said mechanical pencil holder 204 and said ball point pen-holder 205 is fitted into and engaged with the rear end side of the sheath shaft portion 222 of the sheath 202 to which are attached the mechanical pencil holder 204 and the ball point pen-holder 205 such that they are reversibly rotatable as a unit.

More specifically, when a locking claw 224*a* of the engaging shaft portion 224 at the rear end of the sheath shaft portion 222 is inserted into and passed through a reduced diameter shaft insert hole 280 defined at a shaft center portion of the cam cylinder 208, the locking claw 224*a* engages with the rear end wall surface of said shaft insert hole 280, whereby the cam cylinder 208 can rotate around said engaging shaft portion 224.

When the rear end wall surface of said shaft insert hole 280 engages with said locking claw 224*a* as shown in FIG. 31, a distance (b) is defined between the rear end surface of said sheath shaft portion 222 and the front end wall surface of said shaft insert hole 280.

The distance (b) defines a knocking margin for feeding a lead in the mechanical pencil holder 204 and which is equal to or shorter than the aforesaid distance (a).

Accordingly, said cam cylinder 208 becomes forwardly transferable by said distance (b) in the axial direction thereof, such that a knocking operation may be performed.

Furthermore, said cam cylinder 208 is engaged with the rearward outer cylinder 203 in the shaft rotating direction.

As its engaging means, a whirl-stop projection 231, which extends integrally to the inner circumferential surface of said rearward outer cylinder 203 on the rear end side (see FIGS. 31 and 43), is fitted into and engaged with an axial engaging groove 281 defined on the outer circumferential surface of the cam cylinder 208 on the rear end side (see FIG. 31 and FIGS. 41–43).

With such an arrangement described above, said cam cylinder 208 can be incorporatively rotated with the rearward outer cylinder 203.

An outside screwed cylindrical portion 290 of a top machine screw 209 is threadedly engaged with an inside screwed portion 282 provided on the rear end side of said cam cylinder 208. A thrust shaft portion 293 extended integrally from a shaft center portion of said top machine screw 209 is inserted in said engaging shaft portion 224, so that the locking claw 224*a* is more positively and firmly pressed against and engaged with said shaft insert hole 280.

Furthermore, said top machine screw 209 fastens the base portion of a clip 300 to the rear end of the rearward outer cylinder 203.

The aforesaid cam cylinder 208 is provided with, as shown in FIGS. 31 and 32 as well as FIGS. 41 and 42, curved and inclined cam surfaces 283 and 284 on opposite sides of the front end portion, a forward end locking portion 285 disposed at the outermost end of these curved and inclined cam surfaces 283 and 284, and a rear end locking portion 286 of said curved and inclined cam surfaces 283 and 284.

When the sliders 206 and 207 are retracted into the forward outer cylinder 201, the cam engaging projection 261 of the slider 206 in the mechanical pencil holder 204 and the cam engaging projection 271 of the slider 207 in the ball point pen-holder 205 are pressed against and engaged with the curved and inclined cam surface 283 as well as the other curved and inclined cam surface 284 by means of urging forces of the aforesaid respective elastic members 244 and 252.

Thus, as shown in FIGS. 32 and 44, when the cam cylinder 208 is rotated, the cam engaging projections 261 and 271 is rotated, the cam engaging projections 261 and 271 are maintained in an intermediate portion between the curved and inclined cam surfaces 283 and 284, and the mechanical pencil holder 204 and the ball point pen-holder 205 are contained and kept in their retracted positions in the forward outer cylinder 201. Moreover, when the cam engaging projection 261 of the mechanical pencil holder 204 is engaged with the forward end locking portion 285, the mechanical pencil holder 204 projects and at the same time, the cam engaging projection 271 of the ball point pen-holder 205 engages with a rear end locking portion 286, whereby the ball point pen-holder 205 is maintained at its retracted and contained position. Similarly, when the cam engaging projection 261 on the side of the mechanical pencil holder 204 as well as the cam engaging projection 271 on the side of the ball point pen-holder 205 are engaged with the rear end locking portion 286 and the forward end locking portion 285, respectively, the mechanical pencil holder 204 is maintained at its contained position, while the ball point pen-holder 205 is kept at its projected position.

As described above, the writing utensil according to the present embodiment is arranged such that the mechanical pencil holder 204 and the ball point pen-holder 205 are alternately projected and retracted by a rotation of the cam cylinder 208, or they may be contained simultaneously.

Operations of the writing utensil according to the above embodiment will be described hereunder.

When the rearward outer cylinder 203 is rotated in either direction, the cam cylinder 208 is simultaneously rotated in that direction, and the cam engaging projection 261 of the slider 206 in the mechanical pencil holder 204 moves forwardly on the curved and inclined cam surface 283 as shown in FIG. 44. In this case, the rotational load of the cam cylinder 208 acts on said slider 206, but this load is absorbed because the hooking leg portions 260*a*, 260*a* of said slider 206 engages with the opposite side surfaces of the sheath shaft portion as shown in FIG. 39. Thus, said slider 206 slides forwardly and smoothly along said sheath shaft portion 222 and the mechanical pencil holder 204 moves forwardly.

At the same time, the cam engaging projection 271 of the slider 207 in the ball point pen-holder 205 moves on the other curved and inclined cam surface 284 towards the rear end locking portion 286, so that the ball point pen-holder 205 moves rearwardly. This rearward movement is effected by the urging force of the elastic member 252.

When the cam engaging projection 261 on the side of the mechanical pencil holder 204 and the cam engaging projection 271 on the side of the ball point pen-holder 205 engage with said rear end locking portion 286, respectively, the mechanical pencil holder 204 is maintained at the position where it is projected from the forward end of the forward outer cylinder 201, while the ball point pen-holder 205 is contained and kept at its retracted position in the forward outer cylinder 201.

In this condition, when the rearward outer cylinder 203 is knocked, the cam cylinder 208 moves forwardly along with the rearward outer cylinder 203 so that the slider 206 in the mechanical pencil holder 204 is moved forwardly by said cam cylinder 208. Hence, the lead pipe 240 is pushed forwardly and the lead feeding mechanism 242 operates to thereby send out a lead.

From this position, when the rearward outer cylinder 203 is rotated in the other direction, the cam cylinder 208 rotating simultaneously therewith rotates in the other direction, so that the cam engaging projection 261 on the mechanical pencil holder 204 side moves rearwardly along the curved and inclined cam surface 283 of said cam cylinder 208, and the cam engaging projection 271 on the ball point pen-holder 205 side moves forwardly on the other curved and inclined cam surface 284 of said cam cylinder 208.

As a result, the ball point pen-holder 205 advances to a projected position in which the cam engaging projection 271 engages with the forward end locking portion 285, so that it is maintained at said position, while the mechanical pencil holder 204 is retracted and contained.

FIG. 45 illustrates another embodiment of the sliders 206 and 207 wherein either one of the hooking leg portions 260*a* and 270*a* are removed from the sliders 206 and 207 shown in FIG. 39 so that the aforesaid respective sliders 206 and 207 are provided with only one each of the hooking leg portions 260*a* and 270*a* which are adjacent each other.

In this case, the hooking leg portions 260*a* and 270*a* are disposed on respective side portions of said sliders 206 and 207 such that said hooking leg portion 260*a* of the slider 206 on the side of the mechanical pencil holder 204 engages with one side surface of the sheath shaft portion 222 by means of a rotational load of said cam cylinder 208 upon rotation of the cam cylinder 208 towards the direction of forward movement of the mechanical pencil holder 204 (rotation in the direction indicated by arrow (A) in FIG. 45). Similarly, the hooking leg portion 270*a* of the slider 207 on the side of the ball point pen-holder 205 engages with the other side surface of the sheath shaft portion 222 by means of a rotational friction or load of said cam cylinder 208 upon rotation of the cam cylinder 208 towards the direction of forward movement of the ball point pen-holder 205 (rotation in the direction indicated by arrow (B) in FIG. 45).

Hence, said hooking leg portions 260*a* and 270*a* engage alternately with side surfaces of the sheath shaft portion 222 by means of either rotational load of the cam cylinder 208 upon forward movement of the mechanical pencil holder 204 or the ball point pen-holder 205. Therefore, the sliders 206 and 207 will not slip out from the sheath shaft portion 222 due to the rotational load of said cam cylinder 208, and said sliders 206 and 207 will allow the sheath shaft portion 222 to stably and smoothly slide and advance in a manner similar to the above described embodiments.

The other examples of a mechanism for restricting a transfer of a cam cylinder are shown in FIGS. 46–48 as well as FIGS. 49–51 in which the sheath 202 and the cam cylinder 208 are improved, respectively.

First, a construction of the sheath 202 will be described in conjunction with FIGS. 46–48.

A rearward circular stepped portion 223 of the sheath 202 is formed with a diameter equal to a breadth H of the sheath shaft portion 222, and a stopper projection 228 for restricting a rotation of the cam cylinder 208 and a transfer in the axial direction is integrally extended from the outer circumferential portion of the rearward circular stepped portion 223.

A construction of the cam cylinder 208 will be described in conjunction with FIGS. 49–52.

A circumferential slide groove 287 for restricting transfer of the cam cylinder 208 which engages with said stopper projection 228 is defined on the outer circumferential surface of the cam cylinder 208.

The circumferential slide groove 287 extends semi-circumferentially about the circumference on the maximum length side of the cam cylinder 208. The front end of an axial slide groove 288 for assuring knocking operation extends rearward and is connected to an end of the circumferential slide groove 287.

A distance (c) defined between the rear end of the axial slide groove 288 and the rear end of the stopper projection 228 as shown in FIG. 52 is formed with a length equal to the distances (a) and (b) shown in FIG. 31 or with a longer length than that of said distances.

Furthermore, a guide groove 289 for easily assembling the cam cylinder 208 into the sheath 202 and which extends forwardly in the axial direction is defined on a midway portion of said axial slide groove 288.

The stopper projection 228 of the sheath 202 is fitted in the guide groove 289 from the inside thereof when said sheath 202 is inserted into the shaft insert hole 280 of the cam cylinder 208.

More specifically, when the locking claw 224*a* of the sheath 202 is inserted in and passed through the shaft insert hole 280 and the stopper projection 228 is engaged with said guide groove 289 from the inside thereof, the cam cylinder 208 is rotatably meshed and engaged with the engaging shaft portion 224 of the sheath 202. At the same time, said stopper projection 228 abuts against the rear end wall of the circumferential slide groove 287, and the stopper projection slides in said circumferential slide groove 287 by a rotation of the cam cylinder 208, whereby said cam cylinder 208 can be rotated by 180 degrees. Accordingly, the whirl-stop projection 231 for the rearward outer cylinder 203 and the axial engaging groove 281 for the cam cylinder 208 in FIG. 31 become unnecessary and may be omitted.

Furthermore, when said stopper projection 228 is locked by an end of said axial slide groove 288 in said circumferential slide groove 287, said stopper projection 228 becomes slidable in said axial slide groove 288 to permit a forward transfer of said cam cylinder 208 upon performance of a knocking operation to thereby feed out a lead for the mechanical pencil holder 204.

In the present embodiment, therefore, when the stopper projection 228 of the sheath 202 engages with an end of the circumferential slide groove 287 of the cam cylinder 208 by rotating said cam cylinder 208 simultaneously with the rearward outer cylinder 203 in either direction, the rotation of said cam cylinder 208 in that direction is restricted, the mechanical pencil shaft 204 projects from the extreme end of the forward outer cylinder 201 and the ball point pen-holder 205 is contained in its retracted position in the forward outer cylinder 201.

In this condition, when the rearward outer cylinder 203 is knocked, the cam cylinder 208 moves forwardly along with said rearward outer cylinder 203. In this case, when said stopper projection 228 moves rearwardly in the axial slide groove 288 of the cam cylinder 208, it allows a forward movement of said cam cylinder 208. The lead pipe 240 of the mechanical pencil holder 204 is pushed forwardly by means of said cam cylinder 208, so that the lead feeding mechanism 242 operates to feed out a lead.

When a knocking state of said rearward outer cylinder 203 is released, the cam cylinder 208 transfers outwardly by means of the elastic force of the elastic members 244 and 252, and said stopper projection 228 is engaged with the front end of the axial slide groove 288 and is maintained in the circumferential slide groove 287 in a slidable state.

When the rearward outer cylinder 203 is rotated in the other direction from the above described situation, the cam cylinder 208 rotates simultaneously therewith in the other direction, said stopper projection 228 slides in the circumferential slide groove 287 toward the other direction, and the cam engaging projection 261 of the slider 206 in the mechanical pencil holder 204 transfers on the curved and inclined cam surface 283 in a direction towards the rear end locking portion 286, while the cam engaging projection 271 of the slider 207 in the ball point pen-holder 205 transfers on the other curved and inclined cam surface 284 in the reverse direction.

As a result, the ball point pen-holder 205 projects, whilst the mechanical pencil holder 204 retracts to be contained, and the stopper projection 228 is engaged with the other end of said circumferential slide groove 287, whereby rotation of said cam cylinder 208 in the other direction is restricted.

FIG. 53 illustrates another embodiment of a mechanism for restricting a transfer of a cam cylinder wherein a first mechanical pencil holder 204 and a second mechanical pencil holder 205 containing lead different in diameter than the lead contained in the first pencil holder 204 are projected and retracted alternately by means of the cam cylinder 208.

More specifically, axial slide grooves 288 and 288*a* are connected to the opposite ends of the circumferential slide groove 287 for the sake of obtaining a knocking margin for feeding a lead when the respective first and second mechanical pencil holders 204 and 205 are in their respective projected positions.

Under the circumstances, when the cam cylinder 208 is rotated simultaneously with the rearward outer cylinder 203 in either direction, the cam engaging projection 261 of the slider 206 in the first mechanical pencil holder 204 transfers on the curved and inclined cam surface 283 towards the forward end locking portion 285, and the cam engaging projection 271 belonging to the other mechanical pencil holder 205 system transfers on the other curved and inclined cam surface 284 towards the rear end locking portion 286, whereby the first mechanical pencil holder 204 moves forwards, while the second mechanical pencil holder 205 moves rearwards.

When the stopper projection 228 engages with an end of said circumferential slide groove 287, a rotation of said cam cylinder 208 in either direction is restricted, so that the first mechanical pencil holder 204 projects from the forward end of the forward outer cylinder 201 and at the same time, the second mechanical pencil holder 205 is contained in the forward outer cylinder 201 at its retracted position.

In this condition, when the cam cylinder 208 is transferred forwardly by a knocking operation of the rearward outer cylinder 203, a lead is sent out for said first mechanical pencil holder 204.

Then, when said cam cylinder 208 is rotated in the other direction, said first mechanical pencil holder 204 retracts, while the second mechanical pencil holder 205 advances to be projected, and the cam cylinder 208 transfers forwardly by the following knocking operation, whereby a lead is sent out for said second mechanical pencil holder 205.

Thus, the first and second mechanical pencil holders 204 and 205 are projected and retracted respectively by means of opposite rotations of the cam cylinder 208.

When the stopper projection 228 is engaged with an end of the circumferential slide groove 287 such that either of the first and second mechanical pencil holders 204 and 205 is projected, whilst the other mechanical pencil holder is retracted by means of a rotation of said cam cylinder 208 in either direction, said rotation of the cam cylinder 208 in that direction is restricted.

Moreover, a rotation of said cam cylinder 208 in the other direction is restricted when either of said mechanical pencil holders 204 and 205 is retracted, whilst the other mechanical pencil holder is projected by means of a rotation of the cam cylinder 208 in that direction.

Furthermore, when said cam cylinder 208 is rotated by about 90 degrees, the cam engaging projections 261 and 271 of the sliders 206 and 207 in the first and second mechanical pencil holders 204 and 205 are maintained at respective intermediate portions of the curved and inclined cam surfaces 283 and 284 on the opposite sides of the cam cylinder 208. As a consequence, said first and second mechanical pencil holders 204 and 205 are maintained in the forward outer cylinder 201 at their contained positions, respectively.

FIGS. 54 through 59 illustrate another embodiment of a mechanism for restricting a transfer of a cam cylinder wherein a rotation of the cam cylinder 208 is restricted by an engagement of a whirl-stop projection 280*a* extended from the inner circumferential surface of the cam cylinder 208 with a locking groove 224*a* defined on the sheath 202.

More specifically, the whirl-stop projection 280*a* is extended from the inner circumferential surface of the cam cylinder 208 and disposed on the front side of the shaft insert hole 280. Further, the whirl-stop projection 280*a* is a locking projection which engages with the locking groove 203*a* of the rearward outer cylinder 203 and causes the cam cylinder 208 to rotate simultaneously with the rearward outer cylinder 203 as mentioned hereinbelow.

A notched engaging groove 223*a* which engages with said whirl-stop projection 280*a* and restrict its rotation is defined on the outer circumferential surface of the rearward circular stepped portion 223 of the sheath 202 as shown in FIGS. 55–57.

The aforesaid notched engaging groove 223*a* is defined by a groove formed about a portion of the circumference of the rearward circular stepped portion 223 and allows said whirl-stop projection 280*a* to rotate by 180 degrees.

And said cam cylinder 208 is arranged such that upon rotation it is engaged with the inner circumferential surface of the rearward outer cylinder 203 so that the cam cylinder is reversibly rotated simultaneously with the rearward outer cylinder 203.

As the engaging means, the locking projection 208*a*, disposed on the outer circumferential surface on the rear end side of the cam cylinder 208, is allowed to fit in and engage with the locking groove 203*a* defined on the inner circumferential surface of the rearward outer cylinder 203. Alternatively, the locking groove may be defined on the outer circumferential surface on the rear end side of the cam cylinder 208, while the locking projection is formed on the inner circumferential surface of the rearward outer cylinder 203.

FIGS. 60 and 61 illustrate another embodiment of a mechanism for restricting a transfer of a cam cylinder which differs from the above described embodiments in that a rotation of the cam cylinder 208 is restricted upon an engagement of the whirl-stop projection 280*a* which is extended from the inner circumferential surface of the cam cylinder 208, which the cam engaging projections 261 and 271 of the sliders 206 and 207.

In this embodiment, the engaging groove 223*a* of the rearward circular stepped portion 223 in the sheath 202 is not required.

More specifically, in the present embodiment, a whirl-stop projection 280*a* is formed on a rear end locking portion for locking the cam engaging projections 261 and 271 of the sliders 206 and 207 when the refills 204 and 205 are retracted, as shown in FIG. 60.

Therefore, the whirl-stop projection 280*a* engages with the cam engaging projection 261 and 271 to restrict a reversible rotation of the cam cylinder 208, so that an excessive rotation of the cam cylinder 208 can be prevented in the present embodiment. Also in the present embodiment, a knocking margin (a) is maintained between the cam engaging projections 261 and 271 and the rear end locking portions 286, so that a knocking operation may be performed for either of the first and second refills 204 and 205 (wherein the rear end locking portion 286 is formed into a shape indicated by a dotted line in FIG. 60 or 61) or for both of them (wherein the rear end locking portion 286 is formed into a shape indicated by a solid line in FIG. 60 or 61).

FIGS. 62–64 illustrate another embodiment of a construction for connecting the forward outer cylinder 201 with the sheath 202 wherein a reduced diameter cylindrical portion 222A is disposed on the front end side of the forward circular stepped portion 221 of the sheath 202. The cylindrical portion 222A is formed with an outer diameter equal to the inner diameter of the forward outer cylinder 201, and a plurality of locking projections 222B are integrally and protrusively mounted on the outer circumferential surface of the cylindrical portion 222A.

Furthermore, on the rear end side of the forward outer cylinder 201 are defined an axial guide hole 211 for introducing said locking projection 222B from the rear end thereof, and a circumferential locking hole 212 communicating with the front end of said axial guide hole 211 to introduce said locking projection 222B from the outer cylinder axial guide hole 211, as shown in FIG. 63.

On the inlet side of said circumferential locking hole 212 are disposed a locking stepped portion 213, and an inclined elastic locking piece 214 on the opposite side thereof.

Hence, when said locking projection 222B is pushed in said axial guide hole 211 from the rear end thereof and the sheath 202 is rotated in either direction, said locking projection 222B is pushed in the circumferential locking hole 212 and pressingly fitted into and locked by said locking stepped portion 213 by means of elastic force of said elastic locking piece 214. As a consequence, the sheath 202 can be readily detachably connected to the forward outer cylinder 201. Of course, as with the previous embodiment, the locking projection may alternatively be located on the forward outer cylinder and the guide hole 211, 212 may be correspondingly located in the outer circumferential portion of the cylindrical portion 222A.

Another embodiment of the present invention will be described hereinbelow by referring to the accompanying drawings.

FIGS. 65–80 illustrate one embodiment of the writing utensil according to the present invention in which reference numeral 301 designates an outer cylinder for the writing utensil, and a junction outer cylinder 302 is detachably connected to the rear end portion of the outer cylinder 301.

A manner for connecting these members is such that a reduced diameter forward end circular portion 320 formed on the forward end side of said junction outer cylinder 302 is detachably forced into and connected with an enlarged diameter rear end cylindrical portion 310 formed on the rear end side of said outer cylinder 301.

In this case, the engagement is effected in such a manner that whirl-stop projections 311, disposed on diametrically opposite sides of the inner circumferential surface of said rear end cylindrical portion 310, are fitted in axial engaging grooves 321 defined at diametrically opposite positions on the outer circumferential surface of said forward end circular portion 320, or the former member is threadably attached to the latter member as shown in FIGS. 69 and 70. Thus, said junction outer cylinder 302 is engaged with said outer cylinder 301 so as to prevent relative rotation thereof.

As shown in FIGS. 67–70, said forward end circular portion 320 involves a shaft insert hole 322 defined in its shaft center portion, and two slide holes 323 and 324 for inserting refills defined on opposite sides of said shaft insert hole 322 and displaced by 90 degrees from said axial engaging grooves 321 (see FIGS. 68 and 69).

A mechanical pencil holder 303 (first refill) and a ball point pen-holder 304 (second refill) are inserted slidably into these slide holes 323 and 324 along the axial direction thereof, respectively, as shown in FIG. 65.

In this case, as shown in FIGS. 68 and 69, said slide holes 323 and 324 are formed such that said mechanical pencil holder 303 and said ball point pen-holder 304 may be smoothly slid while bending (flexing) during advancement and projection by forming the holes with enlarged elliptical cross-sections towards the rear end side thereof.

As shown in FIGS. 65 and 68, reference numerals 323*a* and 324*a* designate annular projections extending from the inner circumferential wall on the forward end of said slide holes 323 and 324, which lock the front ends of elastic members 334 and 342 and prevent the mechanical pencil holder 303 and the ball point pen-holder 304 from slipping out of the slide holes 324 and 325.

With respect to said mechanical pencil holder 303, a lead guide 331 is detachably connected to the forward end of a lead pipe 330 inserted in either of said insert holes (e.g. 323). Accordingly, leads can be supplied to said lead pipe 330 after pulling the junction outer cylinder 302 off from the outer cylinder 301, when said lead pipe 330 is pulled off from a lead guide 331.

In this mechanical pencil holder 303, a lead feeding mechanism 332 is disposed on the forward end side of the lead guide 331. Furthermore, the lead feeding mechanism 332 comprises a lead chuck, a chuck fastening ring (not shown) and a first elastic member 333.

The ball point pen-holder 304 is detachably connected to the front end of the pen attaching shaft 340 inserted slidably into the other of the slide holes (e.g. 324). In this case, said ball point pen-holder 304 may be connected to the front end of the pen attaching shaft 340 through a pen-holder 341 as shown in FIG. 72.

In the case described above, the pen-holder 341 comprises a small diameter connecting cylindrical portion 341A with which is meshed and connected a forward end small diameter shaft portion 340*a* of the pen attaching shaft 340 by means of press fitting, adhesive bonding or the like, a somewhat larger diameter meshing cylindrical portion 341B which is integrally connected with the forward end of said connecting cylindrical portion 341A and with which is capable of meshing and connecting the lead pipe 330 of said mechanical pencil holder 303, and a larger diameter meshing cylindrical portion 341C which is connected to the forward end of said meshing cylindrical portion 341B and with which is detachably connected the mechanical pencil holder 304 on the rear end side.

In this pen-holder 341 refills can be interchanged when the ball point pen-holder 304, meshed and connected with the larger diameter meshing cylindrical portion 341C, is pulled out and another mechanical pencil holder, which differs from said mechanical pencil holder 303 in that it contains lead of a different diameter type is meshed and connected with said meshing cylindrical portion 341B.

To the respective rear ends of said mechanical pencil holder 303 and ball point pen-holder 304 are integrally connected cam engaging members (sliders) 305 and 306 which are forcibly engaged with a front end cam surface of a cam cylinder 309, which will be described hereinbelow.

As shown in FIGS. 67, 68 and 71, these cam engaging members 305 and 306 are fitted into axial guide grooves 325 and 326 defined on the inner circumferential surface of said junction outer cylinder 302, such that said members are smoothly slid along the axial direction thereof.

And said mechanical pencil holder 303 and said ball point pen-holder 304 are urged in the retracting direction by the elastic members 334 and 342 which are interposed between rear end open wall surfaces of said slide holes 323, 324 and said cam engaging members 305, 306, respectively.

Furthermore, a cap 307 is detachably fitted to the rear end of said junction outer cylinder 302 along the axial direction thereof as shown in FIG. 65. A sheath 308, constructed integrally with a cam cylinder 309, is rotatably and slidably within a cap 307 which is detachably fitted to the rear end of the junction outer cylinder 302.

As shown in FIG. 65 and FIGS. 73–75, the aforesaid sheath 308 is provided with an eraser container 380, a flange 381 locking the forward end of a knocking cap 387 which will be described hereunder, an enlarged diameter cam cylinder 309 which is integrally formed on the same axis with that of the forward end of an intermediate shaft portion 382, a sheath shaft 383 which is extended from the forward end of the intermediate shaft portion 382 and extends forwardly through the shaft center portion of the cam cylinder 309, and a pair of longitudinally engaging projections 384 projecting radially from the outer circumferential surface of the intermediate shaft portion 382.

A clip 400 is engaged with said sheath 308 as shown in FIG. 65. A free end side of the clip 400 projects from an annular hole 170*a* opened along the circumferential surface of the cap 307 to the outside thereof as shown in FIG. 65 and FIGS. 76 through 79.

The aforesaid axial engaging projection 384 is provided for engaging the clip 400 with the sheath 308. More specifically, as shown in FIGS. 65, 76–79 (in FIG. 78, the sheath 308 is indicated by a dotted line), the engaging projection 384 is engaged with an engaging groove 402 of the clip 400 in the sheath 308 passing through an insert hole 401 of the clip 400, the clip 400 and the sheath 308 are rotatable simultaneously, and the sheath 308 axially is movable with respect to the clip 400. Accordingly, the sheath 308 and the cam cylinder 309 are simultaneously rotated with a rotation of the clip 400, whereby the mechanical pencil holder 303 or the ball point pen-holder 304 is projected and retracted. In addition, since only the sheath 308 is transferable in the axial direction, the sheath 308 can be displaced by a knocking operation such that a lead is fed out from the mechanical pencil holder 303.

Thus, said clip 400 has a cam cylinder rotating function for rotating the cam cylinder 308 and the sheath 308, a function not normally performed with a clip.

In this case, relative rotation between the clip 400 and an annular groove 307*a* of the cap 307 through which is passed the clip 400 is restricted so as to restrict rotation of the cam cylinder 309, as shown in FIG. 79. More specifically, as shown in FIG. 79, the annular groove 307*a* of the cap 307 is opened over more than half of the circumference, whereby the clip 400 is restricted to a rotation of about 180 degrees. As a result, the cam cylinder 308 is prevented from rotating excessively.

Furthermore, as shown in FIG. 65, a distance a is maintained between the rear wall of the clip 400 and the flange portion 381 of the sheath 308 on the extreme end side thereof. This distance a provides a knocking margin, so that the mechanical pencil holder 303 can send out a lead in a smooth manner.

The aforesaid cam cylinder 309 is provided with, as shown in FIGS. 73 and 74, curved and inclined cam surfaces 391 and 392 disposed at the front end portion on the opposite sides of the cam cylinder 309, a forward end locking portion 393 placed on the forwardmost end of these curved and inclined cam surfaces 391 and 392, and a rear end locking portion 394 for said curved and inclined cam surfaces 391 and 392.

The cam engaging member 305 of the mechanical pencil holder 303 and the cam engaging member 306 of the ball point pen-holder 304 are forcibly engaged with the curved and inclined cam surface 391 and 392 by means of an urging force of the aforesaid elastic members 334 and 342, respectively.

Thus, when the cam engaging members 305 and 306 are maintained at the intermediate portions of the curved and inclined cam surfaces 391 and 392 by means of a rotation of the cam cylinder 309, as shown in FIG. 80, the mechanical pencil holder 303 and the ball point pen-holder 304 are contained and maintained at a retracted position within the forward outer cylinder 301.

Furthermore, when the cam engaging member 305 of the mechanical pencil holder 303 is engaged with the forward end locking portion 393, the mechanical pencil holder 303 projects and at the same time, the cam engaging member 306 of the ball point pen-holder 304 engages with the rear end locking portion 394 so that the ball point pen-holder 304 is maintained at its retracted and contained position. Similarly, when the cam engaging member 305 is engaged with the rear end locking portion 394 on the side of the mechanical pencil holder 303 as well as when the cam engaging member 306 on the side of the ball point pen-holder 304 is engaged with the forward end locking portion 393, the mechanical pencil holder 303 is maintained at its contained position, while the ball point pen-holder 304 is maintained at its projection position.

Thus, the writing utensil according to the present embodiment is arranged such that the mechanical pencil holder 303 and the ball point pen-holder 304 are alternately projected and retracted, or they are simultaneously contained within the forward outer cylinder 301.

In FIG. 65, reference character 386 designates an eraser contained in a cylindrical portion 380 and 387 designates a knocking cap for covering said eraser 386 and which is fitted detachably to the eraser-containing cylindrical portion 380, respectively.

Operations of the writing utensil according to the present embodiment will be described hereinafter.

When the clip 400 is rotated in either direction, the cam cylinder 309 is integrally rotated therewith through the sheath 308, and the cam engaging member 305 of the mechanical pencil holder 304 moves forwardly on the curved and inclined cam surface 391 towards the forward end locking portion 393 as shown in FIG. 80. At the same time, the cam engaging member 306 of the ball point pen-holder 304 transfers on the other curved and inclined cam surface 392 towards the rear end locking portion 394, so that the ball point pen-holder 304 moves rearwardly. Such rearward movement is effected by an urging force of the elastic member 342.

The cam engaging member 305 on the mechanical pencil holder 303 side is engaged with said forward end locking portion 393 and the cam engaging members 305 and 306 on the side of the ball point pen-holder 304 are engaged with said rear end locking portion 394, and at the same time either side of the clip 400 is locked by either wall surface of the annular groove 307*a* of the cap 307 as indicated by a dotted line in FIG. 79.

As a result, rotation of said cam cylinder 309 in either direction is restricted such that said mechanical pencil holder 303 is maintained at the position where it is projected from the forward end of the outer cylinder 301, while the ball point pen-holder 304 is contained and maintained at the retracted position in the outer cylinder 301.

Under these circumstances, when the knocking cap 387 at the rear end of the cap 307 is knocked, said cam cylinder 309 forwardly moves through said sheath 308 by a distance a.

When the cam engaging member 305 of the mechanical pencil holder 303 is forwarded by means of the cam cylinder 309, the lead pipe 330 is advanced forwardly, and a lead feeding mechanism 332 is operated to send out a lead.

When the clip 400 is rotated in the other direction from the situation described above, the cam cylinder 309 rotates simultaneously with said clip 400 through the sheath 308 in the other direction so that the cam engaging member 306 on the side of the mechanical pencil holder 303 moves rearwardly by means of the urging force of the elastic member 334 along the curved and inclined cam surface 391 of the cam cylinder 309. At the same time, the cam engaging member 306 on the side of the ball point pen-holder 304 is pressedly forwarded by means of the other curved and inclined cam surface 392 of said cam cylinder 309.

When the ball point pen-holder 304 is projected from forward outer cylinder 301, the cam engaging member 306 is engaged with the forward end locking portion 393. At the same time, the other side surface of the clip 400 is locked by the other wall surface of the annular groove 307*a* of the cap 307 as indicated by a dotted line in FIG. 79. Thus, when said engaging projection 384 is engaged with the stopper surface of the junction outer cylinder 302 on the side where the ball point pen is sent out, a rotation of said cam cylinder 309 in the other direction is restricted. Then, said ball point pen-holder 304 is maintained at a writing position where it is projected from the outer cylinder 301, and at the same time the mechanical pencil holder 303 is retracted and contained.

While in the above embodiment, the outer cylinder 301 and the junction outer cylinder 302 are separate elements, the junction outer cylinder 302 may be omitted by making the outer cylinder 301 longer.

FIGS. 81 through 83 illustrate a still further embodiment of the present invention which provides a writing utensil construction which prevents breaking or slipping of the lead by causing the whole of a mechanical pencil holder (refill) to be retracted inwardly when an excessive writing pressure is applied to the lead.

In FIGS. 81 through 83 wherein like reference numerals of the above-mentioned embodiment shown in FIGS. 1–14 designate like or corresponding parts, an excessive writing pressure moderating mechanism 500 is mounted on the rear end side of a mechanical pencil holder 4, as shown in FIGS. 81 and 82, and functions to prevent lead breakage, slippage and the like by causing the whole of the mechanical pencil holder 4 to be retracted into the forward outer cylinder 1 when an excessive writing pressure is applied to the lead.

The aforesaid excessive writing pressure moderating mechanism 500 is fitted into the rear end of the mechanical pencil holder 4 and comprises a receiving piece 510 contained movably in a retracted space portion 62 formed within the slider 6, and an elastic member 412, for moderating an excessive writing pressure, which is disposed between the receiving piece 510 and a wall portion 62*a* of said retracted space portion 62 and which urges forwardly the receiving piece 510 and the mechanical pencil holder 4.

It is to be noted that the elastic member is not limited to a cushion spring, but may be any elastic member made of sponge, rubber, plastics and the like. While an elastic member 512 which is separate from the slider 6 has been utilized in the above embodiment, an elastic member molded integrally with the slider 6 may also be used. In this case, the slider 6 is formed of a synthetic resin such as polyacetal, polypropylene, or the like, and the elastic member 512 in the retracted space portion 62 may have any suitable construction such as branched, strip-like, bent strip-like or slit-like, etc., so long as it has an elastic force which can urge forwardly the receiving piece 510.

It is to be understood that a modulus of elasticity of the elastic member 412 is to be smaller than that of another elastic member 45.

Meanwhile a ball point pen-holder 5 is detachably connected to the forward end of a pen attaching shaft 50 inserted slidably into either of slide holes 37 through a pen-holder 51 as shown in FIGS. 81 and 83. Breaking of a lead or the like due to an excessive writing pressure is not a concern in the case of a ball point pen-holder 5; thus, it is not necessary to provide retractability for the pen-holder. Thus, a rearward enlarged diameter portion 51C of said pen-holder 51 is contained immovably in a retracted space portion 72 of the slider 7 as shown in FIG. 83. As described above, since the pen-holder 51 is directly inserted in and fixed to the slider 7, the number of parts can be reduced so that the cost for such a writing utensil can be reduced.

Opening portions of the retracted space portions 62 and 72 are defined on the sides of the aforesaid respective sliders 6 and 7, and it is arranged such that said receiving piece 4 and the rear end enlarged diameter portion 51C of said pen-holder 51 may be inserted through these opening portions.

According to the above construction, the previously mentioned advantages as well as the functions and advantages attained in the above described embodiment can be obtained.

More specifically, in the case when an excessive writing pressure is applied to a lead of a mechanical pencil during a writing or the like operation, a cushioning elastic member 512 having a smaller modulus of elasticity than that of the elastic member 45 is compressed so that the whole mechanical pencil holder 4 is retracted inside the writing utensil, whereby breakage of the mechanical pencil lead or slippage thereof due to opening of a chuck can be prevented.

As described above, according to the present embodiment, since refills are retractably urged forwards by means of an elastic member for moderating an excessive writing pressure, when such an excessive writing pressure is applied to a refill lead, the entire refill is retracted inside the writing utensil. Hence, the present embodiment provides the advantage of preventing breakage and slippage of the refill lead.

As described above, in accordance with the present invention, when a rearward outer cylinder of a writing utensil is rotated in either direction, either cam surface of the first and second sliders is engaged by means of a cam engaging projection which rotates simultaneously with the rearward outer cylinder, whereby either of the first and second refills is projected while the other is retracted. When the rearward outer cylinder is rotated in the other direction, either of the first and second refills is retracted and the other is caused to be projected by said sliders, respectively. Accordingly, the writing utensil of the present invention provides the advantage that unlike conventional writing utensils, a separate cam cylinder is unnecessary, so that the number of parts may be reduced to make the construction and assembly thereof simple so that the productivity thereof is increased.

Furthermore, according to one embodiment of the present invention, since a cam cylinder is integrally constructed with a sheath shaft and said sheath shaft is slidably inserted into a guide means for refills, there is no play during rotation and transfer of said cam cylinder so that said cam cylinder can be smoothly operated. Accordingly, projecting and retracting operations of the refills can be smoothly and positively performed by means of said cam cylinder.

Moreover, since the cam cylinder and the sheath shaft have an integral structure as mentioned above, a reduction in the number of parts may be realized, whereby a construction thereof can be simplified and an assembly of the parts can simply and easily be effected, so that the productivity thereof can be increased and the cost therefor can be reduced.

An additional advantage is that when rotated, projection and a retraction of the refills is simply and smoothly carried out.

Moreover, in accordance with another embodiment of the present invention, first and second refills are slidably attached and set along the axial direction thereof, a sheath detachably connected to a forward outer cylinder is formed into a flat plate, and hooking leg portions are engaged with side surfaces of said sheath by means of rotation of a cam cylinder in a direction in which said refills are caused to be projected. Hence, the aforesaid respective sliders are prevented from slipping off from the sheath due to a rotation load of said cam cylinder and projecting and retracting operations of said refills can be smoothly and positively carried out.

We claim:

1. A dual refill-type writing utensil comprising:

a rearward outer cylinder connected to a rear end portion of a forward outer cylinder, a sheath detachably connected to the rear end portion of said forward outer cylinder, and having a first and a second refill axially slidably mounted thereto, an engaging shaft portion formed on a rear end of said sheath, and slidably engaging said rearward outer cylinder, a first and a second slider connected to rear ends of said first and second refills, respectively, and axially slidably inserted into said rearward outer cylinder, first and second cam surfaces formed on said first and second sliders, respectively, each of said cam surfaces being of a substantially helical shape extending over about 180° of arc, and a cam engaging projection formed on said rearward outer cylinder, for making said cam surfaces of said first and second sliders engage forcibly therewith, one at a time, and, thereby, making said first refill and second refill alternately project upon rotation of the rearward outer cylinder.

2. A dual refill-type writing utensil comprising:

a rearward outer cylinder connected to a rear end portion of a forward outer cylinder, a sheath detachably connected to the rear end portion of said forward outer cylinder, and having a first and a second refill axially slidably mounted thereto, an engaging shaft portion formed on a rear end of said sheath, and slidably engaging said rearward outer cylinder, a first and a second slider connected to rear ends of said first and second refills, respectively, and axially slidably inserted into said rearward outer cylinder, first and second cam surfaces formed on said first and second sliders, respectively, each of said cam surfaces being of a substantially helical shape extending over about 180° of arc, and a cam engaging projection formed on said rearward outer cylinder, for making said cam surfaces of said first and second sliders engage forcibly therewith, one at a time, and, thereby, making said first refill and second refill alternately project upon rotation of the rearward outer cylinder and further having a locking claw formed at a rearward end of said sheath, said locking claw being bifurcated rearwardly so as to be diametrically elastically expandable, and a shaft insert hole formed in said rearward outer cylinder for slidably engaging with said engaging shaft portion.

3. A dual refill-type writing utensil defined in claim 2, characterized by a thrust preventing means interposed in said locking claw for preventing said locking claw from being effected by a diametrically directed thrust.

* * * * *